US006775654B1

(12) United States Patent
Yokoyama et al.

(10) Patent No.: US 6,775,654 B1
(45) Date of Patent: Aug. 10, 2004

(54) DIGITAL AUDIO REPRODUCING APPARATUS

(75) Inventors: Hideaki Yokoyama, Hino (JP); Kazuhisa Matsushima, Hino (JP); Hiroshi Okubo, Hino (JP); Tadayoshi Katoh, Kawasaki (JP); Takashi Saito, Kawasaki (JP)

(73) Assignees: Fujitsu Limited, Kawasaki (JP); FFC Limited, Hino (JP)

( * ) Notice: Subject to any disclaimer, the term of this patent is extended or adjusted under 35 U.S.C. 154(b) by 0 days.

(21) Appl. No.: 09/387,156

(22) Filed: Aug. 31, 1999

(30) Foreign Application Priority Data

Aug. 31, 1998 (JP) ..... 10-246317

(51) Int. Cl.[7] ..... G10L 21/02

(52) U.S. Cl. ..... 704/500; 704/501; 704/503; 704/226; 704/228

(58) Field of Search ..... 704/500, 503, 704/200, 255, 201, 220, 226, 228; 714/758, 747, 755; 375/136

(56) References Cited

U.S. PATENT DOCUMENTS 4,532,636 A * 7/1985 Wilkinson ..... 375/136
5,526,366 A * 6/1996 Jarvinen et al. ..... 714/747
5,615,298 A * 3/1997 Chen ..... 704/201
5,699,485 A * 12/1997 Shoham ..... 704/220
5,917,835 A * 6/1999 Barrett et al. ..... 714/755
6,004,028 A * 12/1999 Bottomley ..... 714/758

FOREIGN PATENT DOCUMENTS

JP 2000-075873 * 3/2000 ..... G10L/13/00

OTHER PUBLICATIONS

ETSI (European Telecommunication Standard 300 580–3).Sep. 1994.*
ETSI (European Telecommunication Standard 300 580–3).Sep. 1994.*

* cited by examiner

*Primary Examiner*—Richemond Dorvil
*Assistant Examiner*—Daniel Nolan
(74) *Attorney, Agent, or Firm*—Katten Muchin Zavis Rosenman

(57) ABSTRACT

A digital audio reproducing apparatus including a receiver receiving modulated data, a demodulator demodulating the modulated data received by the receiver, an audio decoder decoding, in a unit of a frame, digital audio information contained in the modulated data demodulated by the demodulator, and an audibility corrector for effecting audibility correction on failing digital audio information contained in a frame that failed to be decoded, when the audio decoder fails to decode the digital audio information.

7 Claims, 24 Drawing Sheets

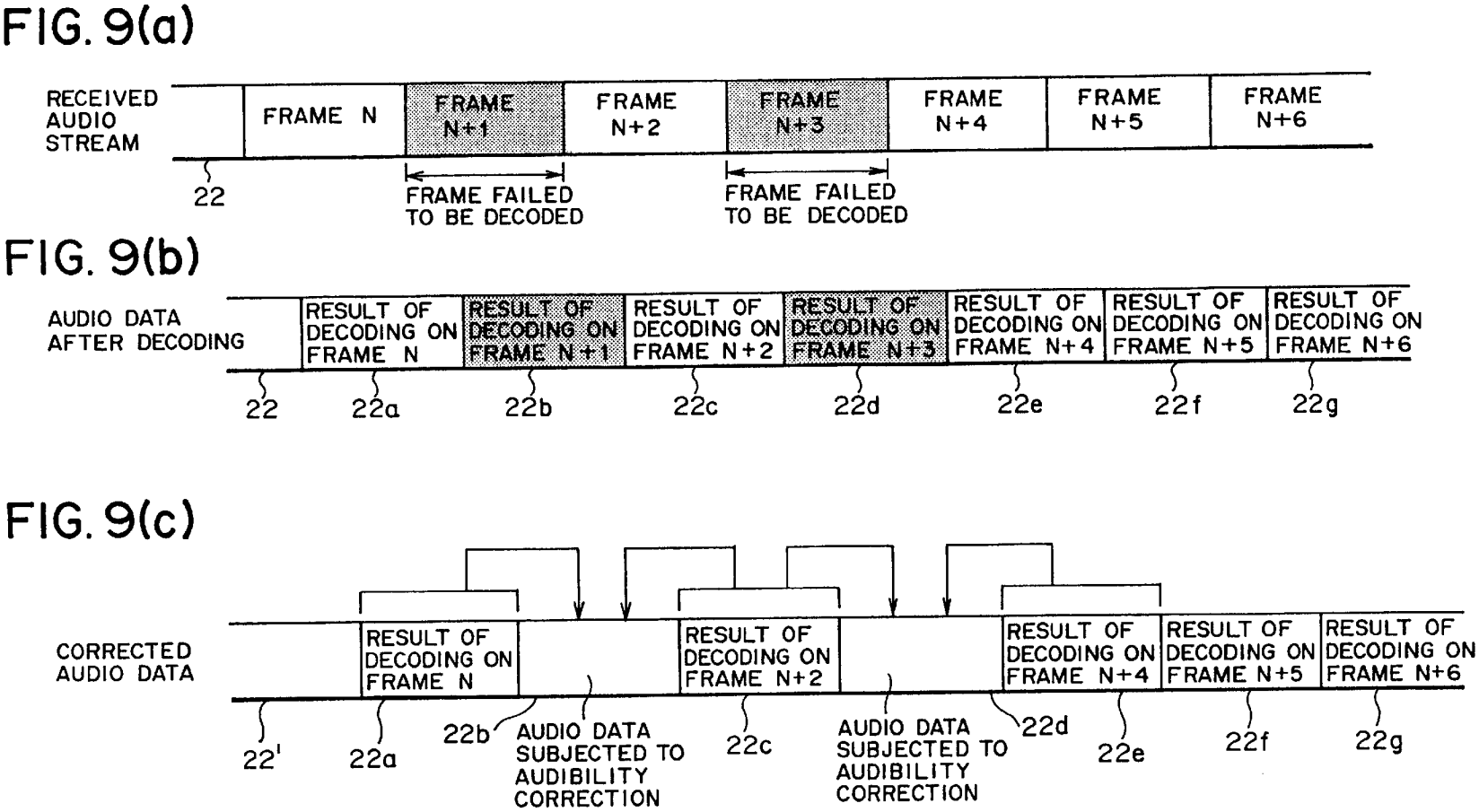
FIG. 9(a)
RECEIVED AUDIO STREAM
FRAME N
FRAME N+1
FRAME N+2
FRAME N+3
FRAME N+4
FRAME N+5
FRAME N+6
FRAME FAILED TO BE DECODED
FRAME FAILED TO BE DECODED
22
FIG. 9(b)
AUDIO DATA AFTER DECODING
RESULT OF DECODING ON FRAME N
RESULT OF DECODING ON FRAME N+1
RESULT OF DECODING ON FRAME N+2
RESULT OF DECODING ON FRAME N+3
RESULT OF DECODING ON FRAME N+4
RESULT OF DECODING ON FRAME N+5
RESULT OF DECODING ON FRAME N+6
22
22a
22b
22c
22d
22e
22f
22g
FIG. 9(c)
CORRECTED AUDIO DATA
RESULT OF DECODING ON FRAME N
RESULT OF DECODING ON FRAME N+2
RESULT OF DECODING ON FRAME N+4
RESULT OF DECODING ON FRAME N+5
RESULT OF DECODING ON FRAME N+6
AUDIO DATA SUBJECTED TO AUDIBILITY CORRECTION
AUDIO DATA SUBJECTED TO AUDIBILITY CORRECTION
22'
22a
22b
22c
22d
22e
22f
22g

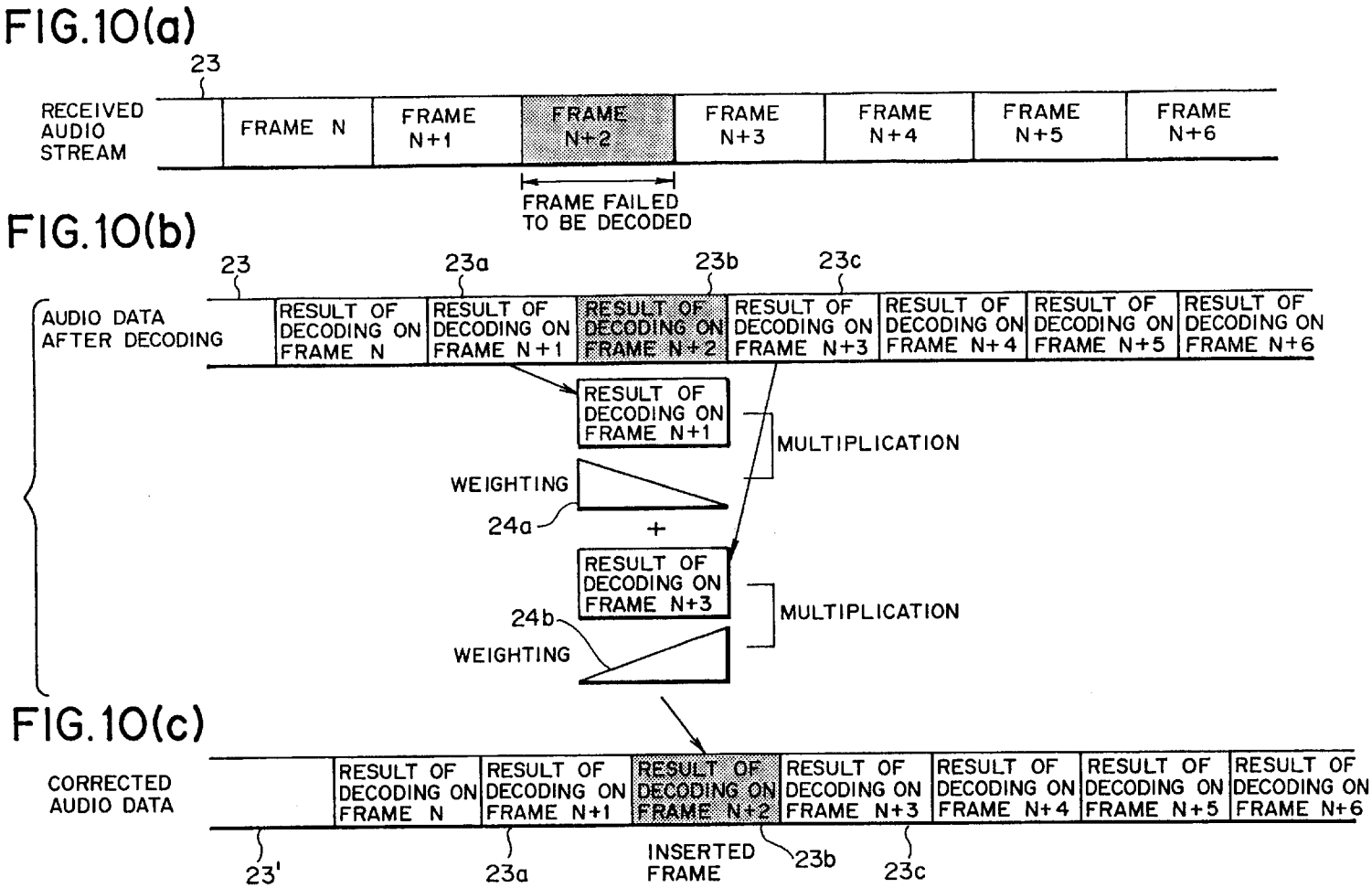
FIG.10(a)
23
RECEIVED AUDIO STREAM
FRAME N
FRAME N+1
FRAME N+2
FRAME N+3
FRAME N+4
FRAME N+5
FRAME N+6
FRAME FAILED TO BE DECODED
FIG.10(b)
AUDIO DATA AFTER DECODING
23
RESULT OF DECODING ON FRAME N
23a
RESULT OF DECODING ON FRAME N+1
23b
RESULT OF DECODING ON FRAME N+2
23c
RESULT OF DECODING ON FRAME N+3
RESULT OF DECODING ON FRAME N+4
RESULT OF DECODING ON FRAME N+5
RESULT OF DECODING ON FRAME N+6
RESULT OF DECODING ON FRAME N+1
WEIGHTING
24a
+
MULTIPLICATION
RESULT OF DECODING ON FRAME N+3
24b
WEIGHTING
MULTIPLICATION
FIG.10(c)
CORRECTED AUDIO DATA
23'
RESULT OF DECODING ON FRAME N
RESULT OF DECODING ON FRAME N+1
23a
RESULT OF DECODING ON FRAME N+2
INSERTED FRAME
23b
RESULT OF DECODING ON FRAME N+3
23c
RESULT OF DECODING ON FRAME N+4
RESULT OF DECODING ON FRAME N+5
RESULT OF DECODING ON FRAME N+6

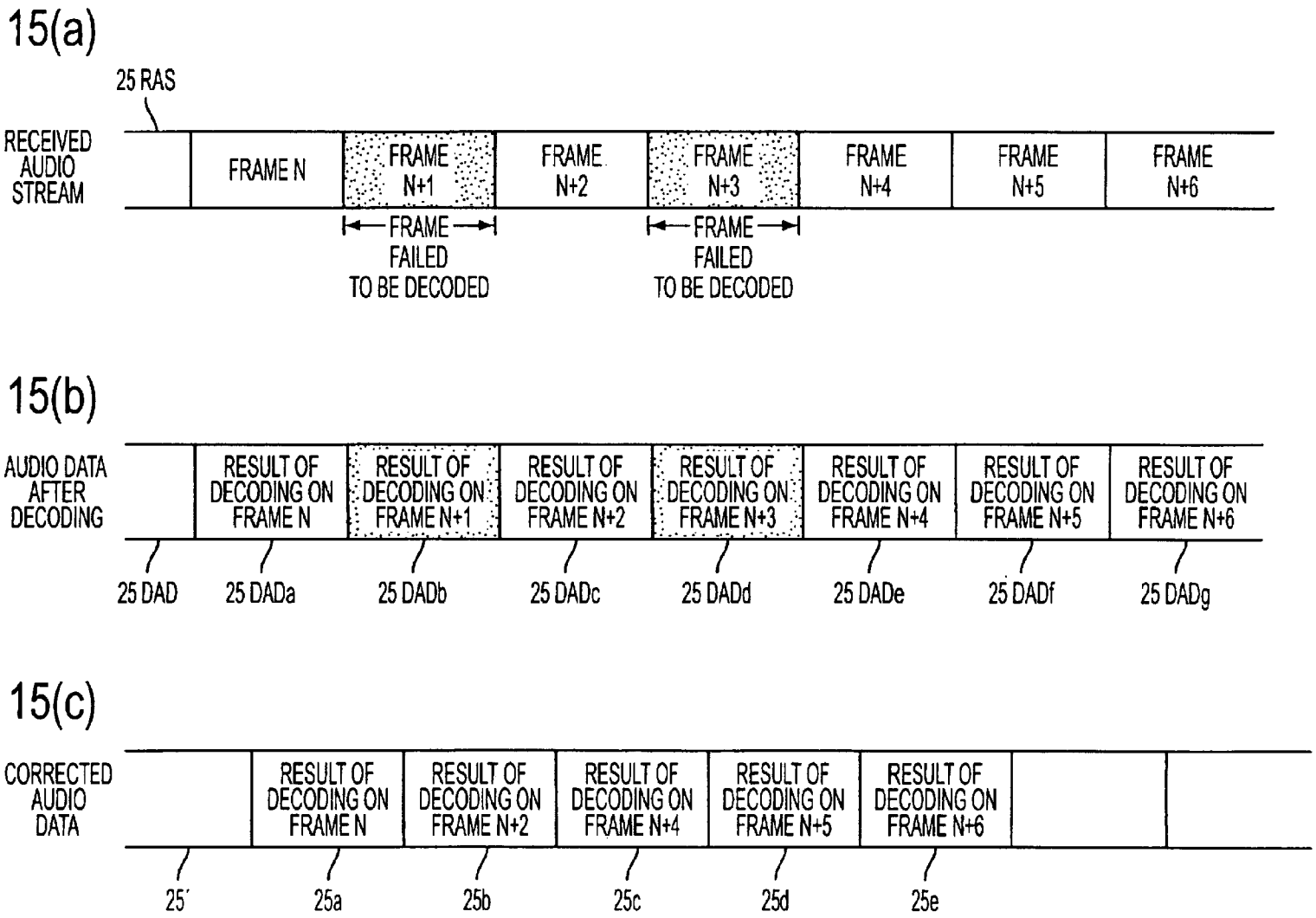
FIG. 15(a)
RECEIVED AUDIO STREAM
25 RAS
FRAME N
FRAME N+1
FRAME N+2
FRAME N+3
FRAME N+4
FRAME N+5
FRAME N+6
FRAME FAILED TO BE DECODED
FRAME FAILED TO BE DECODED
FIG. 15(b)
AUDIO DATA AFTER DECODING
25 DAD
RESULT OF DECODING ON FRAME N
25 DADa
RESULT OF DECODING ON FRAME N+1
25 DADb
RESULT OF DECODING ON FRAME N+2
25 DADc
RESULT OF DECODING ON FRAME N+3
25 DADd
RESULT OF DECODING ON FRAME N+4
25 DADe
RESULT OF DECODING ON FRAME N+5
25 DADf
RESULT OF DECODING ON FRAME N+6
25 DADg
FIG. 15(c)
CORRECTED AUDIO DATA
25'
RESULT OF DECODING ON FRAME N
25a
RESULT OF DECODING ON FRAME N+2
25b
RESULT OF DECODING ON FRAME N+4
25c
RESULT OF DECODING ON FRAME N+5
25d
RESULT OF DECODING ON FRAME N+6
25e

DIGITAL AUDIO REPRODUCING APPARATUS

BACKGROUND OF THE INVENTION (1) Field of the Invention

The present invention relates to an apparatus for extracting digital audio information from data which contains digital audio information and is transmitted by way of a radio transmission path, and for decoding the extracted digital audio information and reproducing an audio signal. More particularly, the present invention relates to a digital audio reproducing apparatus suitable for use in a mobile receiver for receiving digital broadcasting programing broadcast by a satellite.

(2) Description of Related Art

Recently, in parallel with putting digital satellite broadcasting into practice, there have been developed and proposed various image data compression system, audio data compression systems and the like. Also, there are discussed systems of various manner for receiving digital satellite broadcasting by a receiver carried in a mobile unit.

When satellite broadcasting is to be received, in general, it is necessary to prepare a parabolic antenna for receiving the radio wave of which frequency is allocated by an authority. Therefore, it was unrealistic for a user of the mobile unit to prepare such an antenna to receive the satellite broadcasting. However, since S-band (2.6 GHz band) frequency (which is particularly unsusceptible against rain), is allocated for mobile units to receive the satellite broadcasting, it is realistic for the mobile user who lacked receiving means to now receive sought-after satellite broadcasting.

When data containing digital audio information is transmitted from a geostationary satellite to a portable receiving terminal or a terminal carried in a vehicle on the ground in a broadcasting situation with mobile units as targets, the data containing digital audio information is sometimes dropped midway of the radio wave transmission. This occurs when the mobile unit passes through the shadow place of the broadcast radio wave such as a crowded group of buildings, trees, a bridges under a tunnel and so on, such that the broadcasting radio wave is prevented from being transmitted by these obstacles, resulting in a broadcast break on the receiving side. In the field of broadcasting technology, it is substantially impossible to send data repeatedly from the broadcasting station to each of the plural receivers upon each repeating broadcasting request. Therefore, it is essential to keep a reproduction of the broadcasting data even at breaks in the radio wave reception.

In a receiving environment in which the mobile unit receives radio waves as described in the above manner, when a mobile unit on the ground fails to receive transmitted data from the geostationary satellite in a normal fashion, a disturbance is caused in a picture or a break in audibility. Although it is relatively easy to reduce the annoyance of a video program viewer from the disturbance in picture reproduction, it is quite difficult to reduce the annoyance coming from breaks in the sound with the mere countermeasure of muting or the like. Particularly, when audio broadcasting is provided for mobile unit users and the driver of a vehicle is listening to a broadcast of sound intensively, any sound breaks are truly annoying. Thus, there is a great need to improve audibility in such conditions.

The following novel measures have been taken to resolve the above-mentioned challenges.

① When the radio wave transmission is interrupted due to any obstacle, novelty the receiving terminal stops broadcast reproduction.

② If the "shadow area" of the broadcasting satellite is caused in a wide area, a gap filler (retransmission equipment) or similar equipment is installed to reduce the radio wave shadow area. Alternatively, a plural number of broadcasting satellites remote from one another are utilized for transmitting radio waves to novelly resolve the above challenges.

③ Error correction functions, for example, one using an interleave, intraframe coding, interframe coding and so on are driven to restore lost data, and depth of the interleave and code length of the error correction code are optimized to cope with the obstacle of the radio wave transmission gap.

④ Radio wave transmission is carried out by using a time diversity system in which the same transmission data is transmitted with a time lag.

However, a break in transmission interrupts as described in item ① above. Because of this break in transmission the annoyance to a listener is unacceptable. Particularly when an audio broadcast is provided for mobile unit users, such interruption in the radio wave reception draws attention to the user with a broken signal so there is a definite need to avoid such interruptions. The avoidance of such interruptions may be solved as disclosed herein by the invention.

The countermeasure gap filler introduced in item ② is effective because radio waves are supplied from the gap fillers to the "shadow area" of the satellite radio wave which can extend beyond the "shadow area" gap in transmission caused by buildings. However, there are numerous "shadow areas" across the country such as the "shadow areas" of groups of small buildings, trees, a large-sized vehicle approaching from an opposite side of a road and the like. Therefore, it is unrealistic from an economic standpoint to install gap fillers to eliminate all possible "shadow areas." Numerous areas are left in which it is incapable of receiving a radio wave. Further, even if a reasonable number of gap fillers are installed, the economic constraints will result in the "shadow areas" being made too small, the radio wave receiver eventually moving to another area in which it becomes capable of receiving the radio wave again. However, if the receiver is carried in a mobile unit such as a motor vehicle, when the vehicle passes through an area in which the radio wave is not supplied it is inevitable to have a point in which the radio waves are not received. Furthermore, if another mobile unit is as an obstacle preventing radio waves from being transmitted, the temporary lack of reception of the radio wave is brought about.

On the other hand, if a plurality of broadcasting satellites are available for transmitting radio waves, it is possible to reduce the areas in which the radio waves are not received. However, it is difficult to achieve a reasonable effect due to the economic cost of providing satellite coverage. For example, if a relatively inexpensive geostationary satellite for use as a BS broadcasting is utilized to serve also as the audio signal broadcasting means, the greater the area in which the radio wave reception is attempted apart from the equator, the smaller angle of elevation directing the north or south orientation now becomes available for receiving radio waves. Further, if a LEO (Low Ear Orbit) satellite is employed for supplying radio waves, for example, more than totally eight satellites may be utilized; with at least four satellites on each of the two orbits intersecting with each other at right angle, at a great amount of installation cost.

If the scheme of interleave or error correction introduced in the item ③ is employed, the bit error cannot be eliminated completely. For example, if a coded data compression system such as an MPEG system is employed, decoding is carried out at the unit of the frame. Therefore, there can exist a case in which a frame is deleted in spite of the fact that the frame contains only one bit error. Yet, much redundant data will be generated adding for error correction, resulting in the deterioration of radio wave utilization efficiency.

Further, if the time diversity system described in item ④ is employed, another carrier wave will be prepared, leading to deterioration in the channel utilizing efficiency.

SUMMARY OF THE INVENTION

The present invention in view of the above aspects, with an object of the present invention, for example, to provide a digital audio reproducing apparatus of a simplicity which provides a solution of the challenges of when a radio wave cannot be received temporarily, such as when the apparatus is utilized with a mobile terminal in a mobile satellite broadcasting system at an S-band frequency. In such an example, reproduction is carried out with satisfactory audibility even though the reproduced audio signal suffers from interruption due to the break of the broadcasting radio wave. Another object of the present invention is to provide a digital audio reproducing apparatus of simplicity in which provides continued broadcasting reproduction with no audibility challenges without the difficulty of preparing another carrier wave and increasing the number of relaying stations, without deteriorating the efficiency of radio wave utilization.

Accordingly, the present invention, for example, provides a digital audio reproducing apparatus which includes a receiving means for receiving modulated data containing coded digital audio information sent in a unit of frame, demodulating means for demodulating the modulated data received by the receiving means, audio decoding means for decoding in a unit of frame digital audio information contained in the modulated data demodulated by the demodulating means, and audibility correcting means for carrying out audibility correction. The audibility correcting means uses at least one sample of digital audio information selected from out of forward (forward indicates signal elements received or processed immediately ahead of the element being examined) digital audio information that has been sent before failing digital audio information accommodated in a frame fails to be decoded and has been successfully decoded by the audio decoding means and backward (backward indicates subsequent signal elements that were transmitted after the element preceding) digital audio information that has been sent after the failing digital audio information and has been successfully decoded by the audio decoding means, when the audio decoding means fails to decode the digital audio information. According to the above arrangement, it is possible to carry out correction of audibility from a practical standpoint without increasing the number of gap fillers or relaying stations, and it is even possible to continue broadcasting reproduction with the broadcasting radio wave interrupted due to obstacles. Therefore, investment cost can be reduced.

According to the present invention, the audibility correcting means may be arranged to carry out the audibility correction by using only the forward digital audio information. Alternatively, the audibility correcting means may be arranged to carry out the audibility correction by using only the backward digital audio information. Further, the audibility correcting means may be arranged to carry out the audibility correction by using both the forward digital audio information and the backward digital audio information.

According to the above arrangement, it becomes possible to carry out broadcasting reproduction via a simple process without a large investment on gap fillers. Further, as a satellite station need not transmit redundant data, the radio wave frequency band can be more effectively utilized.

According to the present invention, the audibility correcting means may comprise a first smoothing processing means for smoothing the boundary between corrected data that has been subjected to the audibility correction by using the forward digital audio information or the backward digital audio information and non-corrected data that has not been subjected to the audibility correction.

According to the above arrangement, natural sound with no noise from an audibility standpoint can be made available by a novel simple apparatus at a low cost.

According to the present invention, the audibility correcting means may be arranged to carry out an averaging process via an inclined weight distribution on the forward digital audio information and the backward digital audio information to create corrected data from subjection to the audibility correction.

According to the above arrangement, interpolation can be carried out regardless of the correlation in audio data between frames which are placed closely to each other. Therefore, it is possible to provide an apparatus with a simple arrangement in which even with the mobile receiving terminal traveling into a "shadow area" of the radio wave, satisfactory sound audibility is achieved and continuously available without any interruption. Accordingly, it is possible to reduce the cost of providing expensive equipment such as a gap filler or the like, with significant cost reduction via the disclosed system.

Accordingly, the present invention provides a digital audio reproducing apparatus including receiving means for receiving modulated data containing coded digital audio information sent in a unit of frame, demodulating means for demodulating the modulated data received by the receiving means, audio decoding means for decoding in a unit of frame digital audio information contained in the modulated data demodulated by the demodulating means, and audibility correcting means for carrying out audibility correction by deleting failing digital audio information accommodated in a frame which has failed to be decoded, when the audio decoding means fails to decode the digital audio information.

According to the above arrangement, it is possible to carry out a satisfactory audibility correction pragmatically without increasing a number of gap fillers or relaying stations, and it becomes possible to continue broadcasting reproduction even if the broadcasting radio wave is interrupted due to obstacles. Therefore, investment cost can be reduced.

According to the present invention, the audibility correcting means, for example, is arranged such that when the audibility correcting means deletes the failing digital audio information and places pieces of the digital audio information neighboring to the failing digital audio information to achieve audibility correction, the audibility correcting means selects a position where the pieces of the digital audio information neighboring the failing digital audio information have the audio signal levels most coincident to each other.

Further the present invention provides that the audibility correcting means can be arranged where the audibility correcting means deletes the failing digital audio information and thereby places pieces of the digital audio information neighboring the failing digital audio information proximate each other achieving audibility correction, as the audibility correcting means selects a position where the pieces of the digital audio information neighboring the failing digital audio information have the audio signal levels and the audio signal slopes most coincident to each other.

In addition, the audibility correcting means can include a second smoothing processing means for smoothing the boundary caused when the audibility correcting means deletes the failing digital audio information and places the pieces of the digital audio information neighboring the failing digital audio information close to each other, in another embodiment.

According to the above arrangement, the audio signals are connected to each other at the most appropriate position from an audibility standpoint. Therefore, excellent audio reproduction is achieved, with natural sound with no noise from an audibility standpoint achieved.

Further, the audibility correcting means can include means for time-adjusting data insertion inserting time adjusting data for correcting a time lag caused when the audibility correcting means deletes the failing digital audio information. The time adjusting data inserting means can be arranged to insert 0-level data (0-level adjustment data indicates an initial time-measuring sample value set at zero time for achieving time adjustment) or minute level data (minute level adjustment data indicates a value sampled at minute durations for achieving time adjustment) into the digital audio data at a position with a small audio signal level. Further, the means for time adjusting data insertion can be arranged to create the time adjusting data from pieces of the digital audio information neighboring the failing digital audio information. Further, the time adjusting data inserting means can be arranged to insert the time adjusting data into the digital audio data at a position having an absolute value of the volume change amount of the audio signal larger than a first set value.

According to the above arrangement, even if a number of frames are placed close to each other, the data stream can achieve real tune broadcasting because time adjustment is carried out. Furthermore, even if the time adjusting data to be inserted contains or causes noise, the disclosed invention allows the magnitude of the noise to become relatively small with respect to the signal level near the position at which the time adjusting data is inserted. Therefore, the noise is masked by the high signal level position, hence the noise is barely discernible.

According to the present invention, the means for time adjusting data insertion can be arranged to search a predetermined range of the digital audio information after the position where the failing digital audio information is deleted, for a position at which an absolute value of the volume change amount of the audio signal is smaller than a second set value, and to insert the time adjusting data thereat. Further, the second set value is arranged to be variable so that it has a positive correlation with a mean volume value within a predetermined time range or a predetermined number of frames or a volume value obtained by an averaging process with an inclined weight distribution carried out such that a preceding portion remote (i.e. a preceding portion distant) from the current position is applied with a smaller weighting coefficient.

Accordingly, broadcasting data of an accurate time is achieved without any audibility challenges.

According to the present invention, the means for time adjusting data insertion is arranged to search a predetermined range of the digital audio information after the position where the failing digital audio information was deleted, for a position where the volume of the audio signal becomes smallest, and inserts the time adjusting data thereat.

According to the above embodiment, even if a number of frames are placed close to each other, the data stream can follow the real time property of the broadcasting because of the time adjustment achieved. Furthermore, even if the tune adjusting data to be inserted contains or causes noise, the volume of the noise itself becomes small and hence not conspicuous. Particularly when the mobile unit is operated on at an ordinary noise level, the noise is almost non-discernible from an audibility standpoint.

Further, according to the present invention provides a digital audio reproducing apparatus with a receiving means for receiving modulated data containing coded digital audio information sent in a frame unit, demodulating means for demodulating the modulated data received by the receiving means, audio decoding means for decoding digital audio information contained in the modulated data which is demodulated by the demodulating means, and an audibility correcting means for carrying out audibility correction. The audibility correcting means allows that when the audio decoding means fails to decode the digital audio information, the audibility correcting means deletes the failing digital audio information accommodated in a frame which has failed to be decoded. The audibility correcting means transforms the forward digital audio information having a time dimension which has been sent before the failing digital audio information and has been successfully decoded by the audio decoding means as well as backward digital audio information having the time dimension that has been sent after the failing digital audio information which has been successfully decoded by the audio decoding means, into a frequency domain. The audibility correcting means creates intermediate frequency domain digital audio information from the forward digital audio information and the backward digital audio information having the frequency dimension after the transformation, applies an inverse transformation on the intermediate frequency domain digital audio information obtaining intermediate digital audio information having a time dimension, weights and places the intermediate digital audio information at the position where the failing digital audio information is deleted or proximate thereof, such that audibility is corrected.

According to the present invention, the audibility correcting means may be arranged to multiply the intermediate digital audio information with a window function, placing the resulting digital audio information at the position where the failing digital audio information is deleted or a vicinity thereof.

According to the above arrangement, it is possible to achieve satisfactory practical audibility correction without increasing a number of gap fillers or relaying stations, and further achieve continued broadcast reproduction even with broadcasting radio wave interruption due to obstacles at reduced cost.

According to the present invention, there is provided a digital audio reproducing apparatus for use in a mobile unit which receives and reproduces modulated coded data containing digital audio information sent in a unit of frame from an accumulating medium or a transmitting medium by way of a satellite, including receiving means for receiving the modulated data, demodulating means for demodulating the modulated data received by the receiving means, audio decoding means for decoding in a unit of frame digital audio information contained in the modulated data demodulated by the demodulating means, and audibility correcting means for audibility correction on failing digital audio information accommodated in a frame which has failed to be decoded, when the audio decoding means fails to decode the digital audio information.

According to the above arrangement, the audibility correction can be easily carried out upon transmitting broadcasting radio waves and investment in mobile satellite broadcasting system reduced.

Accordingly, the present invention provides a digital audio reproducing apparatus for receiving and reproducing modulated data subjected to an interleave operation at least one of the frames neighboring a desired frame constituting broadcast digital data composed of a plurality of frames that is rearranged such that the frame is placed apart from the desired frame by a predetermined time duration, with receiving means for receiving the modulated data, demodulating means for demodulating the modulated data received by the receiving means, audio decoding means for decoding in a unit of frame digital audio information contained in the modulated data demodulated by the demodulating means, and audibility correcting means for carrying out audibility correction the on failing digital audio information accommodated in a frame which has failed to be decoded, when the audio decoding means fails to decode the digital audio information.

According to the above arrangement, if a mobile unit passes an area in which a signal is not supplied and signal reception is incapable in a burst, continuous frame drop can be prevented audibility correction is achieved.

BRIEF DESCRIPTION OF THE DRAWINGS

FIG. 7(*b*) is a diagram showing data subjected to the interleave processing and sent from a broadcasting station multiplexed on a time axis;

FIG. 8(*b*) is a diagram demonstrating program data after the demultiplexing processing;

FIG. 9(*a*) is a diagram demonstrating a demultiplexed received audio stream;

FIG. 9(*b*) is a diagram demonstrating audio data after the decoding processing;

FIG. 9(*c*) is a diagram demonstrating audio data after audibility correcting processing in which the forward and backward frames are synthesized;

FIG. 10(*a*) is a diagram demonstrating a demultiplexed received audio stream;

FIG. 10(*b*) is a diagram demonstrating audio data after decoding processing;

FIG. 10(*c*) is a diagram demonstrating audio data after audibility correcting processing in which the forward and backward frames are weighted and added together;

FIG. 15(*a*) is a diagram demonstrating a demultiplexed received audio stream;

FIG. 15(*b*) is a diagram demonstrating audio data after decoding processing;

FIG. 15(*c*) is a diagram demonstrating audio data after audibility correcting processing in which a frame failed to be decoded is deleted and the forward and backward frames are placed close to each other;

FIG. 17(*b*) is a diagram demonstrating audio data after decoding processing;

FIG. 17(*c*) is a diagram demonstrating audio data after audibility correcting processing in which the forward and backward frames are synthesized;

FIG. 19(*b*) is a diagram demonstrating audio data after decoding processing, FIG. 19(*c*) is a diagram showing a magnified view of a frame;

FIG. 19(*d*) is a diagram demonstrating a frame into which 0-level data is inserted;

FIG. 19(*e*) is a diagram demonstrating audio data after audibility correcting processing in which 0-level data is inserted into the audio data at a position having a small audio signal level;

FIG. 20(*b*) is a diagram demonstrating audio data after the audibility correcting processing in which data is inserted in audio data at a position of an audio signal level of an abrupt change;

FIG. 21(*b*) is a diagram demonstrating audio data after the process of audibility correction in which data is inserted into the audio data at a position having an audio volume relatively small within a range;

FIG. 22(*b*) is a diagram demonstrating audio data after the correction of audibility processing in which data is inserted into the audio data at a position having an audio volume change relatively small within a certain range;

FIG. 23(*b*) is a diagram demonstrating audio data after decoding processing;

FIG. 23(*c*) is a diagram demonstrating a predictive spectrum created from a spectrum derived from a frequency transformation of a piece of extracted data;

FIG. 23(*d*) is a diagram showing a process in which data is multiplied with a window function to create interpolating data; and FIG. 23(*e*) is a diagram demonstrating audio data after audibility correcting processing is carried out in the frequency domain.

DESCRIPTION OF THE PREFERRED EMBODIMENTS

Embodiments of the present invention will be described with reference to the attached drawings.

Figure 2:
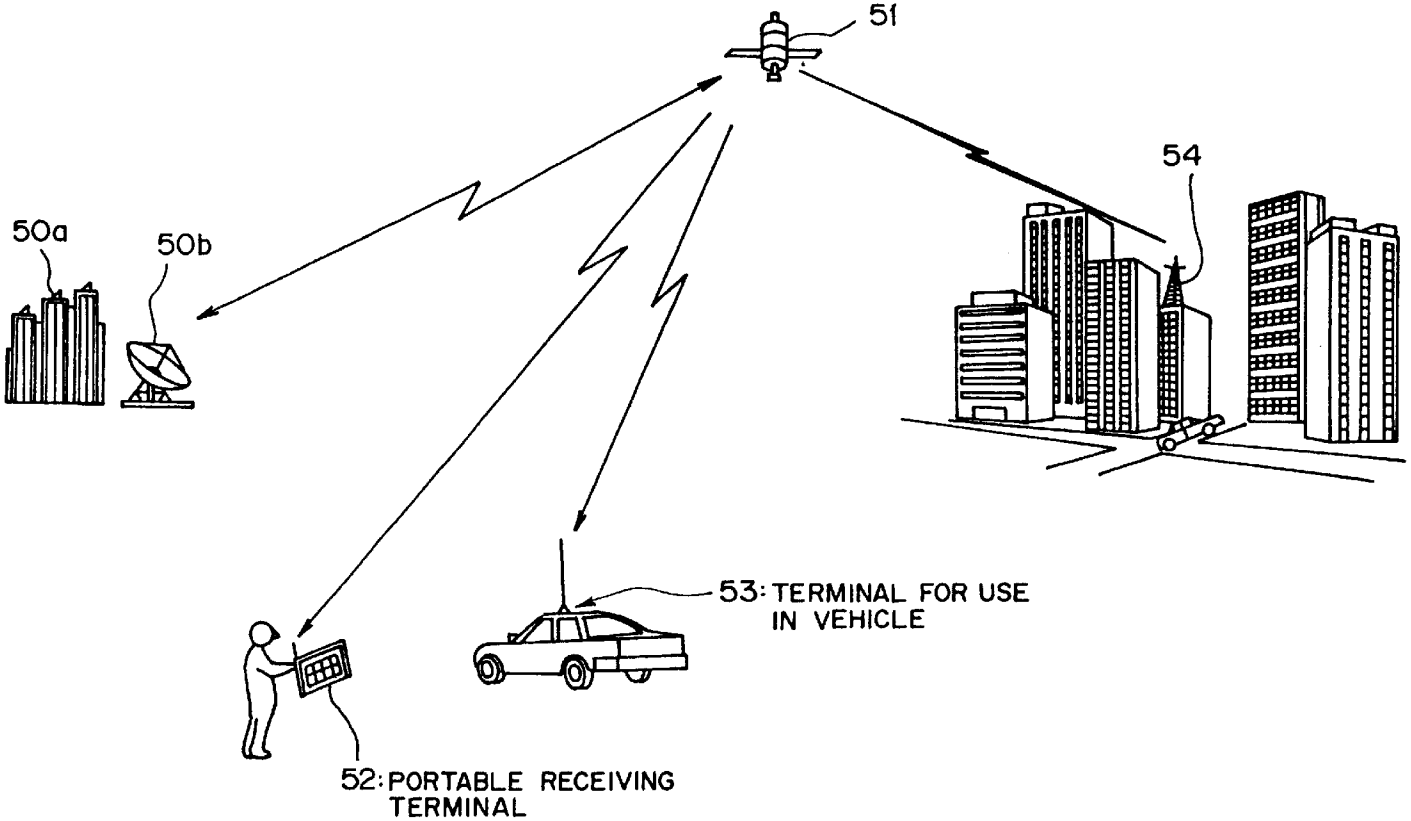
FIG. 2 is a diagram which shows an overall arrangement of a system to which the present invention is applied.

FIG. 2 is a diagram showing an overall system view of an embodiment of the invention shows an arrangement of an S-band mobile digital satellite broadcasting system. The satellite broadcasting system as shown in FIG. 2 is a system in which multimedia digital information such as music of quality equivalent to a compact disk, image data, text data or the like can be broadcast so as to be received throughout, for example, an area such as Japan in a multi-channel functional capacity, and the broadcast data can be received by a vehicle or a portable terminal without any parabolic antenna. A broadcast program is transmitted from a parabolic antenna 50*b* installed in a broadcast station 50*a* to a geostationary satellite (broadcast/communication satellite) 51 by using a Ku-band (14 to 18 GHz band) (up-link). When the broadcast radio wave is transmitted from the geostationary satellite to the ground side (down-link), S-band (2.6 GHz band) is utilized. Therefore, a portable receiving terminal 52 manually carried or a terminal 53 transported via a vehicle at a high speed can receive the broadcast radio wave containing high definition data such as image data or the like without the need of a parabolic antenna. If there is an area in which radio waves are not supplied from the satellite due to a "shadow area" of a building or the like, retransmission equipment such as a gap filler 54 or the like are provided as needed to eliminate gaps in the radio wave supply and reception.

Figure 1:
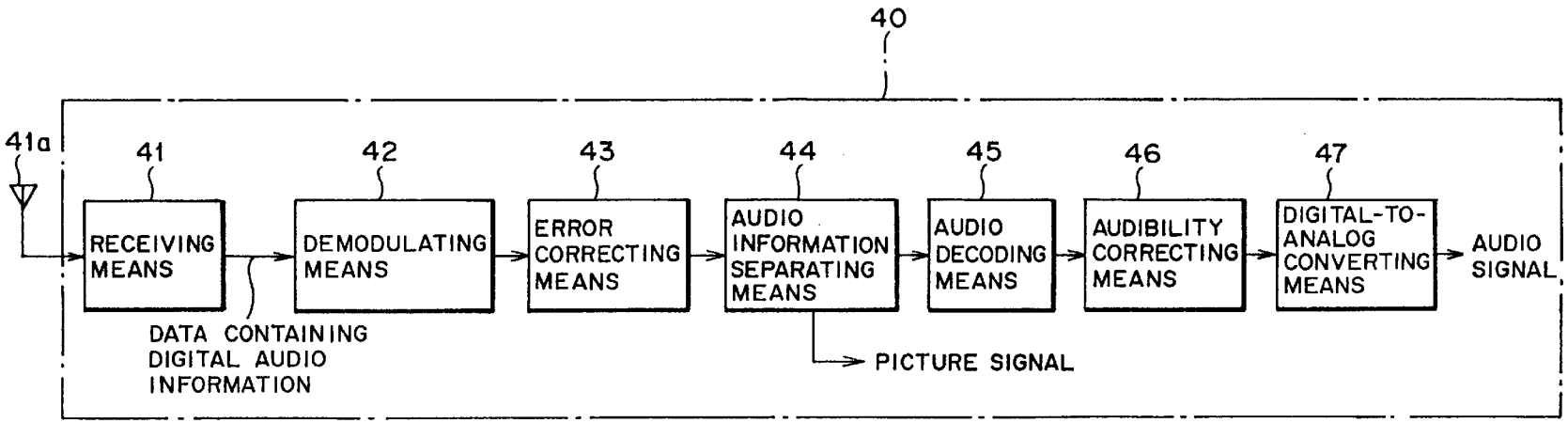
FIG. 1 is a block diagram showing an arrangement of a digital audio reproducing apparatus according to one embodiment of the present invention.

The digital audio reproducing apparatus of the present invention is utilized in the above-described system environment. FIG. 1 is a block diagram showing an arrangement of the digital audio reproducing apparatus in one embodiment of the present invention. The digital audio reproducing apparatus 40 shown in FIG. 1 is a digital audio reproducing apparatus for use with a mobile unit for receiving and reproducing modulated data containing coded digital audio information reproduced from an accumulating medium or a transmission medium and sent from the broadcasting station 50*a* by way of the geostationary satellite 51 in a unit of frame. The digital audio reproducing apparatus 40 includes receiving means 41 for receiving the modulated data, demodulating means 42 for demodulating the modulated data received by the receiving means 41, error correcting means 43 for effecting error correction on a bit series generated from the demodulating means 42, audio information separating means 44 for separating only audio signal data from a picture signal and an audio signal generated from the error correcting means 43, audio decoding means 45 for effecting decoding processing in a unit of frame on the digital audio information from the audio information separating means 44, audibility correcting means 46 for effecting audibility correction on failing digital audio information contained in a frame failed to be decoded when the audio decoding means 45 fails to decode the digital audio information, and digital-to-analog converting means 47 for converting an output signal from the audibility correcting means 46 into an analog signal.

In this way, the modulated data containing the coded digital audio data sent from the broadcasting station 50*a* in a unit of frame is received by the receiving means 41 through an antenna 41*a* of the digital audio reproducing apparatus 40, demodulated by the demodulating means 42, subjected to an error correction processing in the error correcting means 43. After the error correction is effected on the signal, only an audio signal is separated therefrom by the audio information separating means 44. The separated audio signal is decoded by the audio decoding means 45, and at the same time the separated audio signal is subjected to a format check, thus an audio signal is generated in a time-series arrangement.

If the transmitted signal becomes incapable of decoding due to a communication obstacle in a radio transmission path, the audio signal corresponding to the frame is subjected to demodulation processing and then sent to the audibility correcting means 46 as a muted (soundless) signal. Owing to the muting process, the audio signal corresponding to the frame containing the decode failing data is muted when outputted. When the audibility correcting means 46 outputs audio signals, it arranges the frame data lacking data which has failed to be decoded so that no audibility breaks occur.

Figure 4:
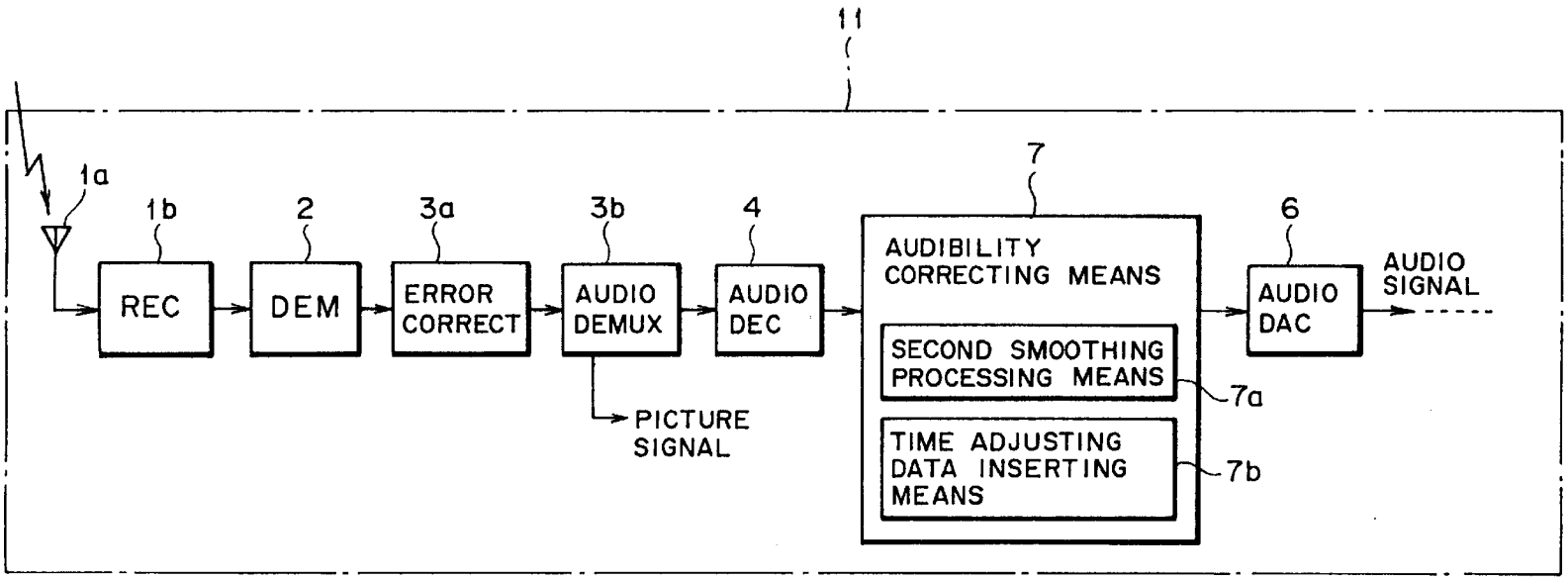
FIG. 4 is a block diagram of the digital audio reproducing apparatus with audibility correcting means as a second mode.
Figure 5:
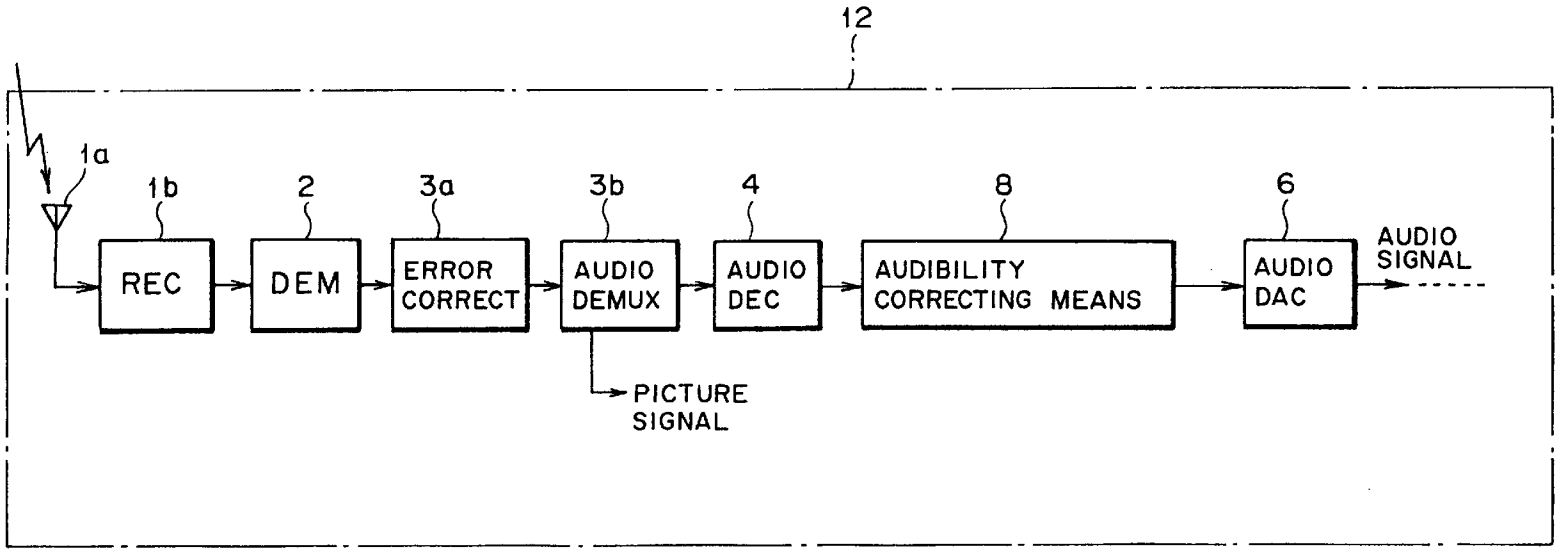
FIG. 5 is a block diagram of the digital audio reproducing apparatus with audibility correcting means as a third mode.

When the audibility correcting means 46 carries out the arrangement on the signal, a mode is selected from the following three modes hereinafter described with reference to FIGS. 3 to 5.

Figure 3:
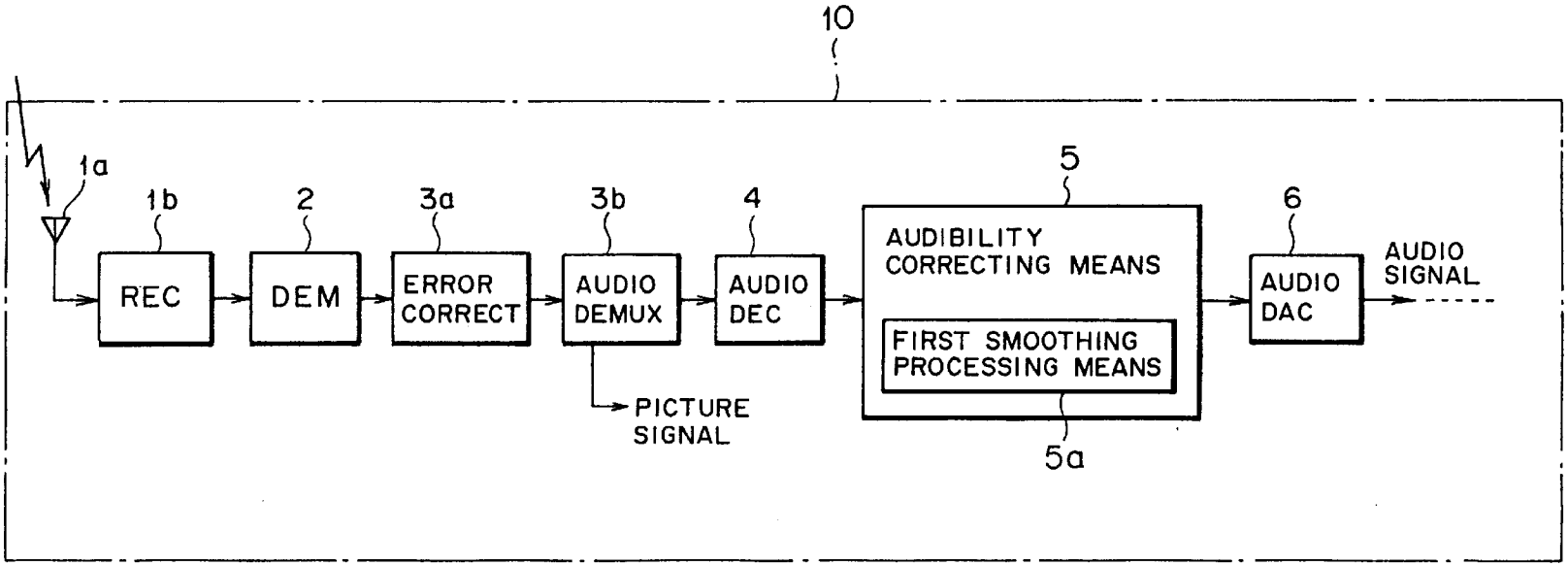
FIG. 3 is a block diagram of the digital audio reproducing apparatus with audibility correcting means as a first mode.

As shown in FIG. 3, a block diagram of the digital audio reproducing apparatus having audibility correcting means as a first mode is embodied. The digital audio reproducing apparatus 10 shown in FIG. 3 includes an antenna 1*a*, a receiving unit 1*b*, an error correcting unit 3*a*, an audio information separating unit 3*b*, an audio decoding unit 4, audibility correcting means 5, an audio digital-to-analog converting unit 6.

The receiving unit 1*b* receives modulated data containing coded digital audio information which is sent through the antenna 1*a* in a unit of frame. The demodulating unit 2 demodulates the modulated data received by the receiving unit 1*b*.

The error correcting unit 3*a* effects error correction on a bit series generated from the demodulating unit 2. The audio information separating unit 3*b* extracts only an audio signal from data generated from the error correcting unit 3*a*. Further, the audio decoding unit 4 (audio decoding means 45) carries out decoding processing in a unit of frame on digital audio information which is generated from the audio information separating unit 3*b* and contained in the modulated data demodulated by the demodulating unit 2.

When the audio decoding unit 4 fails to decode the digital audio information, the audibility correcting means 5 carries out audibility correction by using at least one sample of digital audio information sampled from forward digital audio information sent before the failing digital audio information accommodated in a frame which has failed to be decoded and has been successfully decoded by the audio decoding unit 4 and backward digital audio information that has been sent after the failing digital audio information and has been successfully decoded by the audio decoding unit 4. Further, the audibility correcting means 5 includes a first smoothing processing means 5*a*.

With regard to the digital audio information which serves as a source for carrying out the audibility correction, the audibility correcting means 5 may be arranged to carry out the audibility correction by using only the forward digital audio information. Alternatively, the audibility correcting means 5 may be arranged to carry out the audibility correction by using only the backward digital audio information. Further, the audibility correcting means 5 may be arranged to carry out the audibility correction by using both the forward digital audio information and the backward digital audio information.

The first smoothing process means 5*a* smoothes the boundary between corrected data that has been subjected to the audibility correction by using the forward digital audio information or the backward digital audio information as well as non-corrected data that has not been subjected to the audibility correction. The first smoothing processing means 5*a* carries out a smoothing processing such that when audio signals are placed close to each other, noise generation can be prevented.

Further, the audio digital-to-analog converting unit 6 carries out digital-to-analog conversion on the output data from the audibility correcting means 5.

Figure 6:
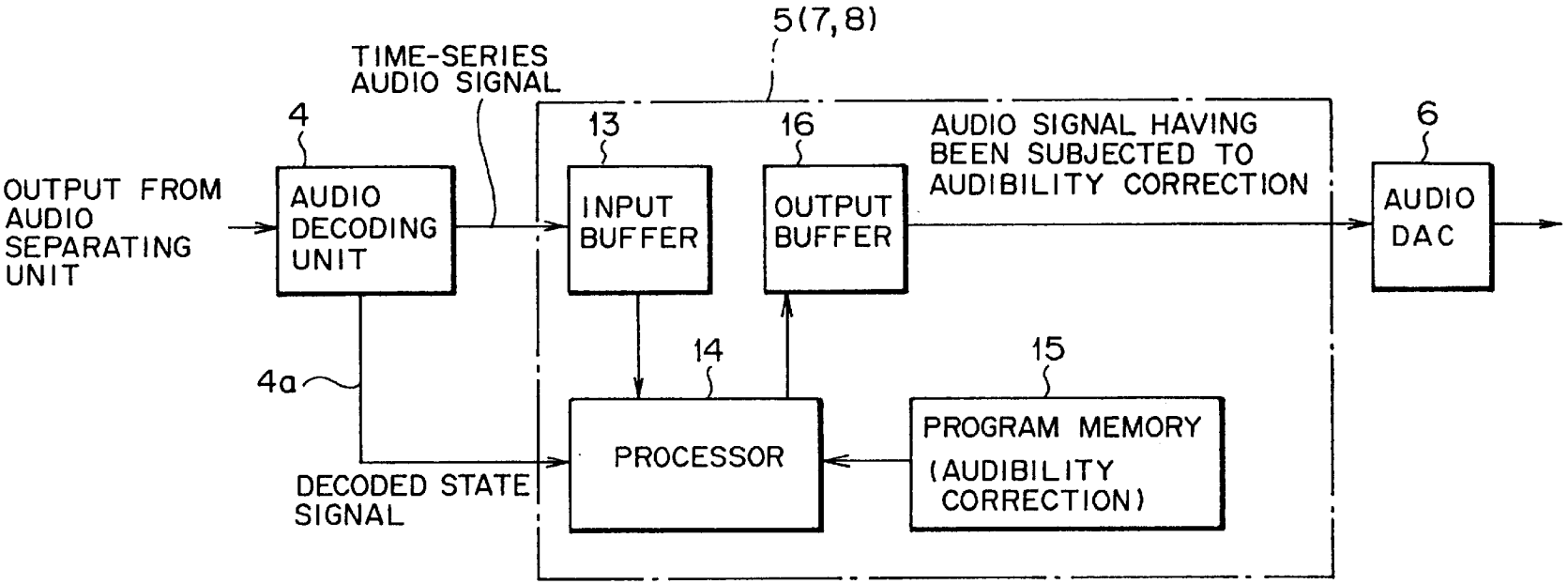
FIG. 6 is a diagram showing an example arrangement of the audio correcting means.

FIG. 6 shows an example of an arrangement of the audibility correcting means 5. The audibility correcting means 5 shown in FIG. 6 is arranged to carry out the audibility correction processing with a DSP (Digital Signal Processor) by using the forward digital audio information or the backward digital audio information, respectively contained in the forward and backward frames of a frame that has failed to be decoded. For this reason, the audibility correcting means 5 includes an input buffer 13, an output buffer 16, a program memory 15, and a microprocessor 14, and these devices are arranged to function for audibility correcting. The audio decoding unit 4 and the audio digital-to-analog converting unit 6 are the same as described earlier.

The input buffer 13 is useful for storing time-series audio data supplied from the audio decoding unit 4. The input buffer 13 can store the data of a plurality of frames. In one embodiment, the number of frames to be stored in the input buffer 13 is equal to at least three frames or more, i.e., a frame currently received by the input buffer 13, a frame preceding by one frame amount relative to the currently received frame, a frame preceding by two frame amount relative to the currently received frame or a frame preceding by more than the amount of two frames relative to the currently received frame.

The program memory 15 stores therein a programmed sequence according to which the DSP carries out the audibility correcting processing. The microprocessor 14 executes the program stored in the program memory 15. The microprocessor 14 is a processor such as a DSP advantageous in arithmetic operation. In the present specification, the DSP and the processor have the same meaning, and thus the word of "microprocessor" in the following description will represent both of them. The output buffer 16 stores a time-series audio signal subjected to the audibility correction in the microprocessor 14.

According to the arrangement, the audio signal separated from the received data signal is subjected to a format check at every frame by the audio decoding unit 4. If the data within the received frame is capable of being decoded the demodulated signal data of one frame amount is then transferred to the input buffer 13 and a decoding completion notice is supplied to the microprocessor 14 by a decoded state signal 4*a*.

Conversely, if the data within the received frame is in a state incapable of being decoded, notice is supplied to the microprocessor 14 by a decoded state signal 4*a*.

If the decoded state signal 4*a* supplied from the audio decoding unit 4 indicates that the received signal is incapable of decoding, the microprocessor 14 carries out the audibility correcting processing by using a forward and/or backward frames of the decoding incapable frame stored in the input buffer 13. Then, the microprocessor 14 stores a time-series audio signal resulting from the correction processing in the output buffer 16. The audio signal having been subjected to the audibility correction stored in the output buffer 16 is supplied to the audio digital-to-analog converting unit 6 in which the audio signal is converted into an analog audio signal. The analog audio signal is converted into an audible sound by means of an audio amplifying circuit (not shown) to be audible for human hearing.

In this manner, the audibility correcting means 5 creates a time-series audio signal corresponding to the timing of the frame failed to be decoded, from a time-series audio signal before the failing digital audio information failed to be decoded and/or a time-series audio signal after the failing digital audio information failed to be decoded by taking advantage of correlation between the forward and backward frames of the frame which has failed to be decoded, to achieve problem-free audibility.

A second mode of the audibility correcting means 46 will hereinafter be described with reference to FIG. 4. FIG. 4 is a block diagram of a digital audio reproducing apparatus having audibility correcting means as the second mode. As shown in FIG. 4, the digital audio reproducing apparatus 11 includes an antenna 1*a*, a receiving unit 1*b*, a demodulating unit 2, an error correcting unit 3*a*, an audio information separating unit 3*b* (audio demax), an audio decoding unit 4, and an audio digital-to-analog converting unit 6. The digital audio reproducing apparatus 11 further includes audibility correcting means 7.

The antenna 1*a*, the receiving unit 1*b*, the demodulating unit 2, the error correcting unit 3*a*, the audio information separating unit 3*b*, the audio decoding unit 4, and the audio digital-to-analog converting unit 6 are similarly arranged as described above. Therefore, they will not be described.

Conversely, the audibility correcting means 7 is arranged in a different manner. That is, when the audio decoding unit 4 fails to decode the above-described digital audio information, the audibility correcting means 7 deletes the failing digital audio information accommodated in the frame which has failed to be decoded, thus carrying out the audibility corrections. To this end, the audibility correcting means 7 includes a second smoothing processing means 7*a* and time adjusting data inserting means 7*b*. Similar to the arrangement shown in FIG. 6, the audibility correcting means 7 is composed of an input buffer 13, a program memory 15, a microprocessor 14, and an output buffer 16, and these components are arranged to function for audibility correcting.

There are two possible ways in which the audibility correcting means 7 deletes the failing digital audio information to attain the audibility correction (how these two ways are achieved is described further on).

(1) The failing digital audio information is deleted and the following received audio data is placed close to the position at which the failing digital audio information is deleted.

(2) The failing digital audio information is deleted and audio data created by synthesizing the forward and/or backward data is inserted ("stuffed") at a point where the failing digital audio information is deleted.

When the audibility correction processing is carried out by using these methods, it is necessary to perform smoothing at a position between the original audio data and the closely placed audio data or between the original audio data and the inserted synthesized audio data so that noise can be suppressed and naturalistic continuous sound reproduction is generated. To this end, the second smoothing processing means 7*a* effects smoothing processing on the boundary between pieces of digital audio information which were placed adjacent to the failing digital audio information before it was deleted.

If the audibility correcting means 7 deletes the failing digital audio information and places the following received audio data close to the position at which the failing digital audio information is deleted, a time lag is caused with respect to the real time broadcast program transmitted from the broadcasting station 50*a*. In order to eliminate such a time lag, a synthesized signal data having a length equal to that of the deleted data is created and inserted ("stuffed") into a frame of different timing. To achieve this, the time adjusting data inserting means 7*b* inserts time adjusting data which is useful for correcting the time lag caused from the deletion of the failing digital audio information.

Further, a third mode of the audibility correcting means 46 is described with reference to FIG. 5. FIG. 5 is a block diagram showing a digital audio reproducing apparatus with audibility correcting means as the third mode. As shown in FIG. 5, the digital audio reproducing apparatus 12 comprises an antenna 1*a*, a receiving unit 1*b*, a demodulating unit 2, an error correcting unit 3*a*, an audio information separating unit 3*b*, an audio decoding unit 4, and an audio digital-to-analog converting unit 6. The digital audio reproducing apparatus 12 further comprises audibility correcting means 8.

The antenna 1*a*, the receiving unit 1*b*, the demodulating unit 2, the error correcting unit 3*a*, the audio information separating unit 3*b*, the audio decoding unit 4, and the audio digital-to-analog converting unit 6 are similarly arranged as described above. Therefore, they will not be described.

Conversely, the audibility correcting means 8 carries out audibility correction in such a manner that, when the audio decoding unit 4 fails to decode the digital audio information, the audibility correcting means 8 deletes failing digital audio information accommodated in a frame which has failed to be decode, transforms the forward digital audio information within a time domain that has been sent before the failing digital audio information and has been successfully decoded by the audio decoding means and backward digital audio information within the time domain that has been sent after the failing digital audio information and has been successfully decoded by the audio decoding means, into a frequency domain, creates intermediate frequency digital audio information from the forward digital audio information and the backward digital audio information within the frequency domain after the transform, effects an inverse transformation on the intermediate frequency digital audio information to obtain intermediate digital audio information within the time domain and weights and places the intermediate digital audio information at the position where the failing digital audio information is deleted or a vicinity thereof, such that audibility correction is achieved.

In order to achieve the audibility correction, similarly to the arrangement shown in FIG. 6, the audibility correcting means 8 is composed of an input buffer 13, a program memory 15, a microprocessor 14, and an output buffer 16, and these devices are arranged to serve for an audibility correcting function.

Further, the audibility correcting means 8 is arranged to weight and add data created by multiplying the intermediate digital audio information with a window function, to a position at which the failing digital audio information is deleted or in vicinity thereof.

The arrangements of the first to third modes described above will carry out audibility correction on a data frame lost in the radio wave transmission path. The audibility correction processing by three types of modes will be described hereinafter.

Initially, the audibility correction processing carried out by the audibility correcting means of the first mode will be described.

Figures 7A, 7B:
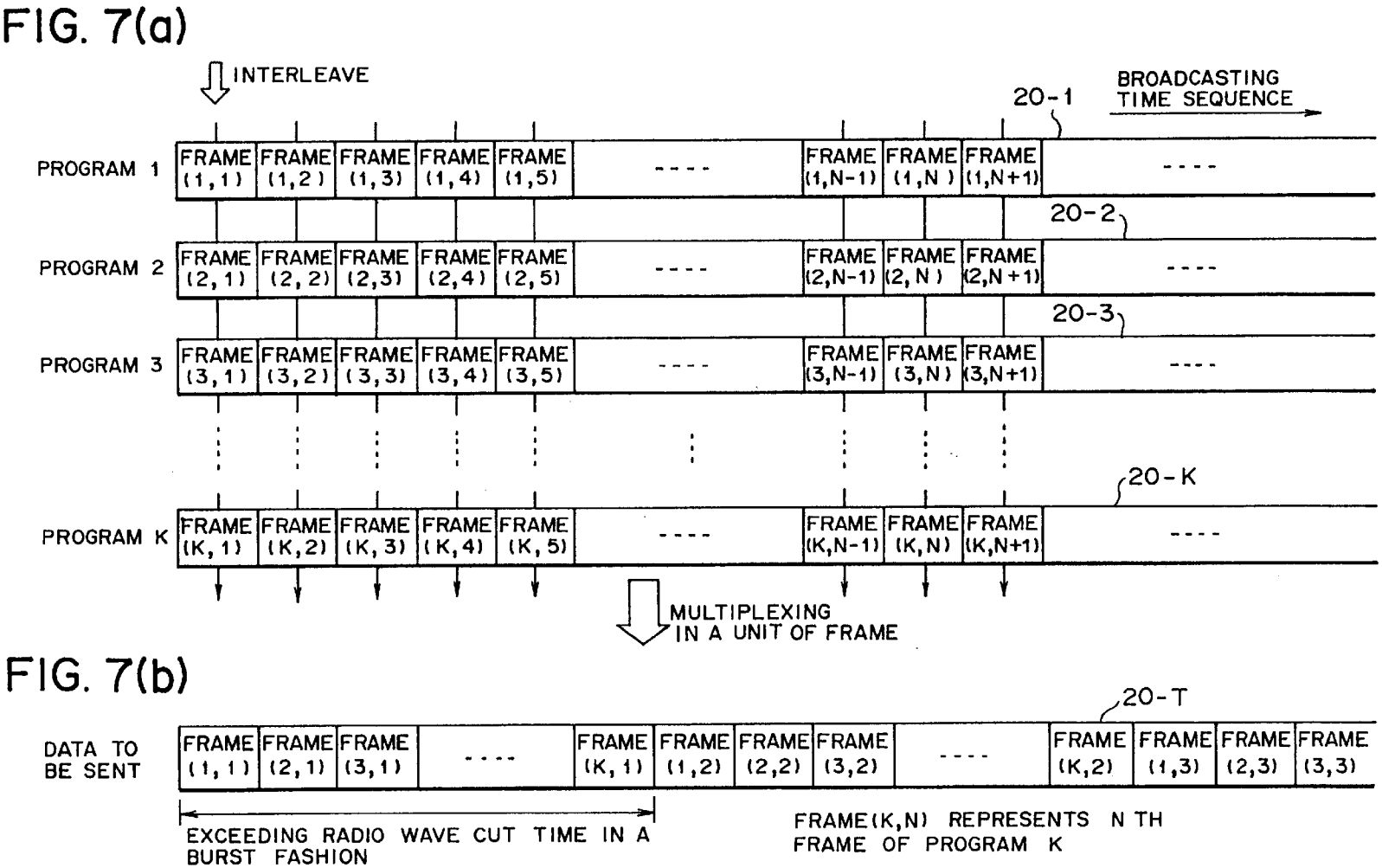
FIG. 7(*a*) is a diagram demonstrating types of program data.

FIGS. 7(*a*) and 7(*b*) show arrangements of audio data sent from the broadcasting station 50*a* and subjected to a frame interleave operation. K kinds of program data 20-1 to 20-K shown in FIG. 7(*a*) are subjected to frame interleave processing and multiplexed on the time axis and then transmitted in a form of transmission data 20-T shown in FIG. 7(*b*).

For example, the program data 201 of FIG. 7(*a*) contains a plurality of data frames (1,1) to (1, N+1) arrayed in the time axis direction. The program data 20K of FIG. 7(*a*) contains a plurality of data frames (K,1) to (K, N+1) arrayed in the time axis direction. The order in which these data frames are transmitted is not arrayed in a chronological sequence but an order in which frame order is changed. That is, the frame arrangement of data to be transmitted is such that (1,1), (2,1), (3,1), . . . (K,1), (1,2), (2,2), (3,2), . . . (K,2), (1,3), (2,3), (3,3), as shown in FIG. 7(*b*). Now, positional relationship between the data same (1,1) and adjacent data frame (1,2), for example, will be described. As shown in FIG. 7(*a*), these frames are placed adjacent to each other within the program data 20-1. However, when these frames are arranged in the transmission data shown in FIG. 7(*b*), the data frame (1,1) and the data frame (1,2) are placed so as to be apart from each other by a time distance which will exceed an expected radio wave cut time in a burst fashion. Since data frames are subjected to the interleave operation as set forth above, the erroneous frames will be dispersed into the program data 20-1 to 20-K. Therefore, if a mobile unit is passing through a place in which the radio wave is not supplied and the mobile unit suffers from a faulty reception situation in a burst fashion, it is improbable for the program data that the mobile unit is receiving to contain continuously erroneous data frames. Accordingly, the audibility correcting means 5 can achieve correction of audibility more effectively.

As described above, the digital audio reproducing apparatus 10 is arranged as a digital audio reproducing apparatus for receiving and reproducing modulated data subjected to an interleave operation in which a desired frame constituting broadcasting digital data composed of a plurality of frames with at least one frame adjacent to the desired frame being placed apart from each other by a predetermined time distance. Further, the digital audio reproducing apparatus 10 is provided with the receiving unit 1*b*, the demodulating unit 2 for demodulating the modulated data received by the receiving unit 1*b*, the audio decoding unit 4 for effecting decoding in a unit of frame digital audio information contained in the modulated data demodulated by the demodulating unit 2 in a unit of frame, and the audibility correcting means 5 for carrying out audibility correction on the failed digital audio information accommodated in a frame failed to be decoded when the audio decoding unit 4 fails to decode the digital audio information.

At the same time, in order to achieve data throughout against any burst error and to achieve an apparatus capable of coping with error with the error correction functionality, the digital audio reproducing apparatus 10 is arranged to spread error in a unit of bit by using a bit interleave operation and a convolution encoding, and then also spread error in a unit of byte by using a byte interleave operation and a Reed-Solomon encoding.

Figure 8A:
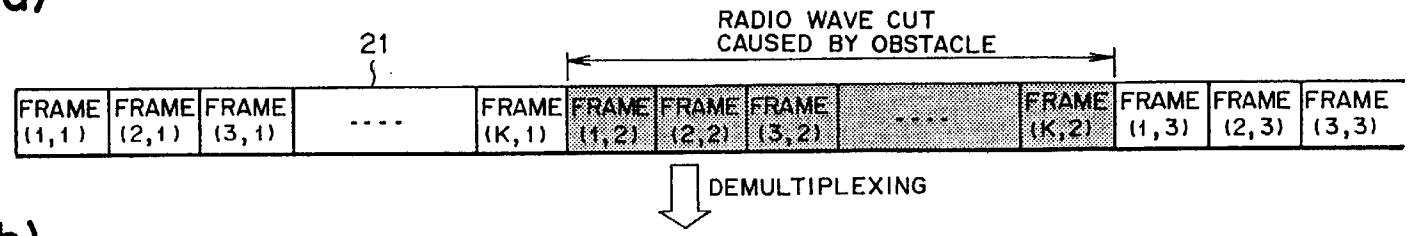
FIG. 8(*a*) is a diagram demonstrating received data having a failing frame due to a radio wave cut.
Figure 8B:
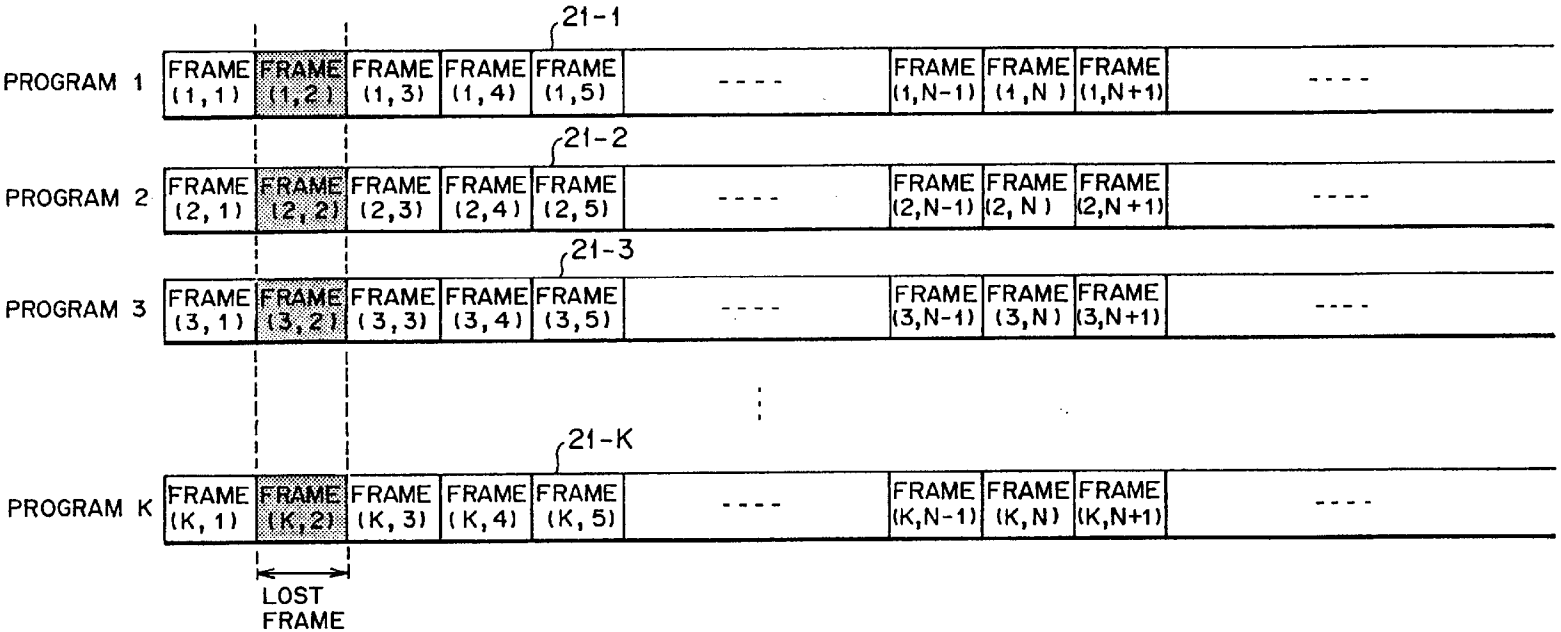

FIGS. 8(*a*) and 8(*b*) show a method for processing received data carried out on the reception side when frames are lost due to radio wave breaks. Received data 21 shown in FIG. 8(*a*) is the data having been subjected to the frame interleave operation on the transmission side, and it lacks data frames of (1,2) to (K,2) due to radio wave breaks in a radio wave transmission path. When the received data shown in FIG. 8(*a*) is demultiplexed (inverse operation of multiplexing or separation) to be formed into respective data frame series of program data 21-1 to 21-K, by the audio information separating unit 3*b* of the digital audio reproducing apparatus 10, each of the data frame series lacks the second frame that has been lost in the transmission path. Thus, the group of erroneous frames contained in the received data shown in FIG. 8(*a*) is dispersed in respective data frame series.

The digital audio reproducing apparatus 10 directs a data frame restoring operation on the received data with a lost frame by using the forward and/or backward frames of the lost frame. An example in which both of the forward and backward frames are utilized for restoring the lost frame will be described with reference to FIGS. 9 and 10.

FIGS. 9(*a*) to 9(*c*) show a method in which correction is carried out by using the forward and backward frames of the lost data frame. An audio stream 22 of the received data shown in FIG. 9(*a*) is a series of received data frames derived from a demultiplexing operation. Therefore, the frames are arrayed in a time sequence. However, some of data frames are lost due to the radio wave break in a transmission path.

FIG. 9(*b*) shows a series of the audio data stream 22 having been subjected to the decoding operation. A frame N at a frame position 22*a* is normally received and frames N+2, N+4, N+5, N+6, at frame positions 22*c*, 22*e*, 22*f*, 22*g* are normally received, respectively.

Conversely, frames corresponding to a frame number N+1 at a frame position 22*b* and a frame number N+3 at a frame position 22*d* are lost.

Then, as shown in FIG. 9(*c*), the audibility correcting means 5 creates frame data corresponding to the frame number N+1 at a frame position 22*b* by synthesizing the frame N before the frame N+1 failed to be decoded and the frame N+2 after the frame N+1 failed to be decoded. The audibility correcting means 5 further creates frame data corresponding to the frame number N+3 at a frame position 22*d* by synthesizing the frame N+2 before the frame N+3 failed to be decoded and the frame N+4 after the frame N+3 failed to be decoded. Thus, corrected audio data 22' is created by interpolation.

While in the above example the audibility correcting means 5 creates corrected data by synthesizing the two frames, i.e., the forward frame and backward frame, the dropped frame may be created by using either one of the forward frame as well as the backward frame.

The above-proposed method may be carried out as follows. That is, the audibility correcting means 5 effects an averaging processing with an inclined weight distribution on the forward digital audio information and the backward digital audio information so that corrected data having been subjected to audibility correction is created.

FIGS. 10(*a*) to 10(*c*) show a method in which the corrected data is created by effecting the averaging processing with an inclined weight distribution on the forward and backward frames. An audio stream 23 of the received data shown in FIG. 10(*a*) having been subjected to demultiplexing operation lacks a frame corresponding to the frame number of N+2 due to the radio wave cut in a transmission path.

As shown in FIG. 10(*b*), the audibility correcting means 5 creates a new data five by adding a frame N+1 positioned at a frame position 23*a* multiplied with a weighting coefficient function 24*a* and a frame N+3 positioned at a frame position 23*c* multiplied with a weighting coefficient function 24*b*. Then, the audibility correcting means 5 "stuffs" the frame position 23*b* with the created new data frame. In this way, audio data 23' having been subjected to the audibility correcting processing as shown in FIG. 10(*c*) can be obtained. The weighting function 24*a* or 24*b* may be a window function such as a triangle wave, a sine wave, a cosine wave, a Hanning function, a Hamming function, and a Gaussian function.

If the created frame is inserted without any adjustment, it becomes unavoidable to generate noises. Thus, the audibility correcting means 5 carries out smoothing processing on boundaries between the corrected data frame created by synthesizing the forward frame and the backward frame and inserted at the position of the dropped frame, and original non-corrected frames neighboring the corrected frame so that noise is eliminated and a naturalistic, continuous sound reproduction audibility achieved.

According to the above method, interpolation can be achieved regardless of the correlation between the audio data frames adjacent to each other. Further, even if the mobile receiving terminal goes into a shade area in which radio wave is discarded, sound reproduction can be achieved with satisfactory audibility without interruption and ease. Therefore, the cost of providing expensive equipment such as the gap filler 54 shown in FIG. 2 can be reduced, and the system can be constructed at a low cost.

Figure 11:
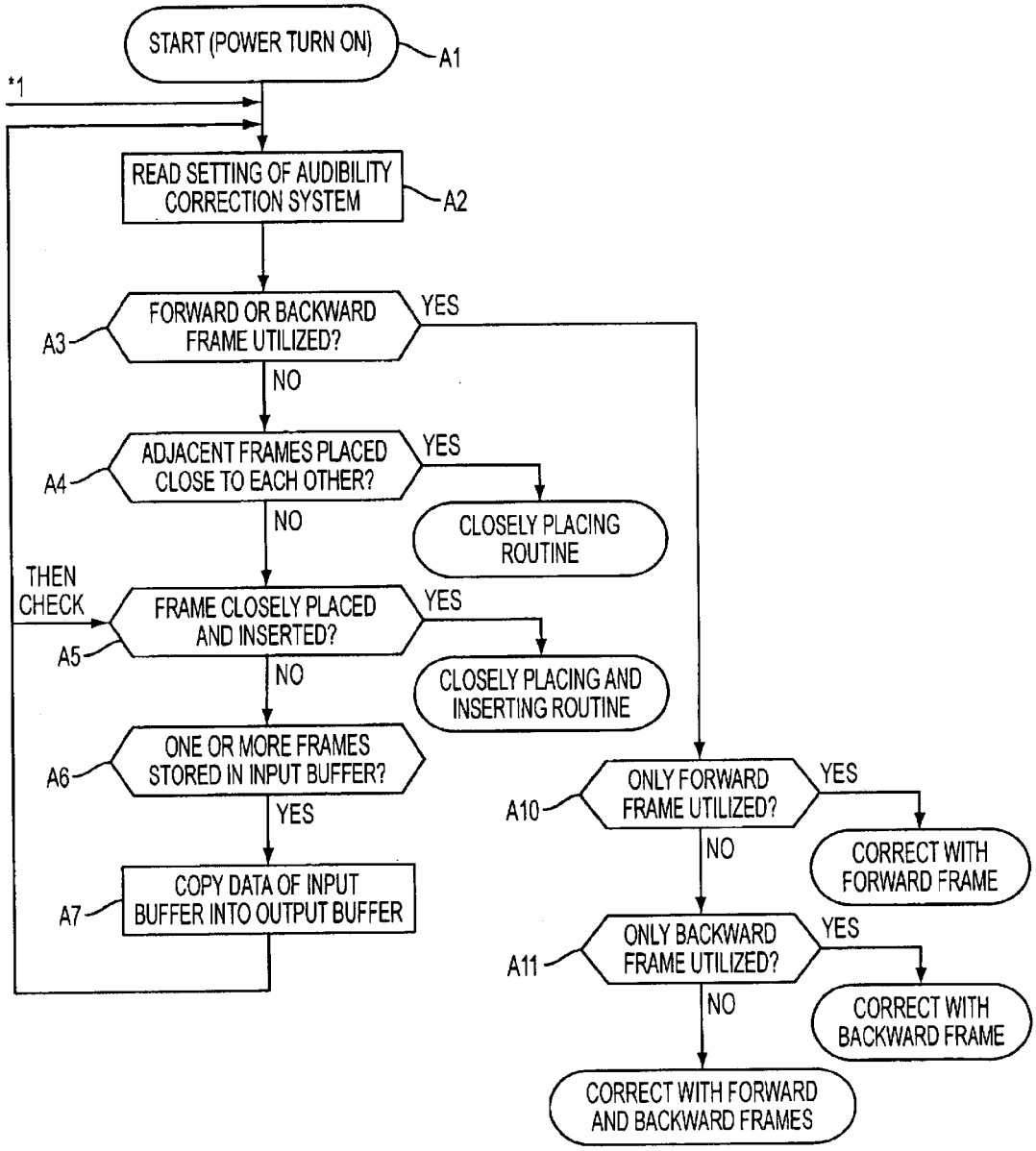
FIG. 11 is a flowchart of a process carried out by the audibility correcting means.

FIG. 11 is a main flowchart of a process carried out by the audibility correcting means 5, 7 and 8. As shown in FIG. 11, when power is turned on (step A1), the audibility correcting means 5, 7, 8 start processing appropriately (point of *1 noted below step A1) in which set contents of the audibility correcting system are read (step A2). The contents (a value) may be set by means of the receiving terminal.

If the set value indicates an audibility correcting system in which audibility correction is carried out by using the forward and backward frames, then the processing goes along the YES route of step A3. If the set value indicates an audibility correcting system in which audibility correction is carried out by using only the forward frame, then the processing goes along the YES route of step A10, wherein correction is effected by using the forward frame (see the processing flow of FIG. 12). If only the backward frame is utilized for the audibility correction the processing executes through the NO route of step A10 to the YES route of step A11, thus the audibility correction is carried out by using only the backward frame (see processing flow of FIG. 13). Further, if both the forward and backward frames are utilized for the audibility correction, the processing goes through the NO route of step A11 to carry out the audibility correction using both of the forward and backward frames (see processing flow of FIG. 14).

Figure 16:
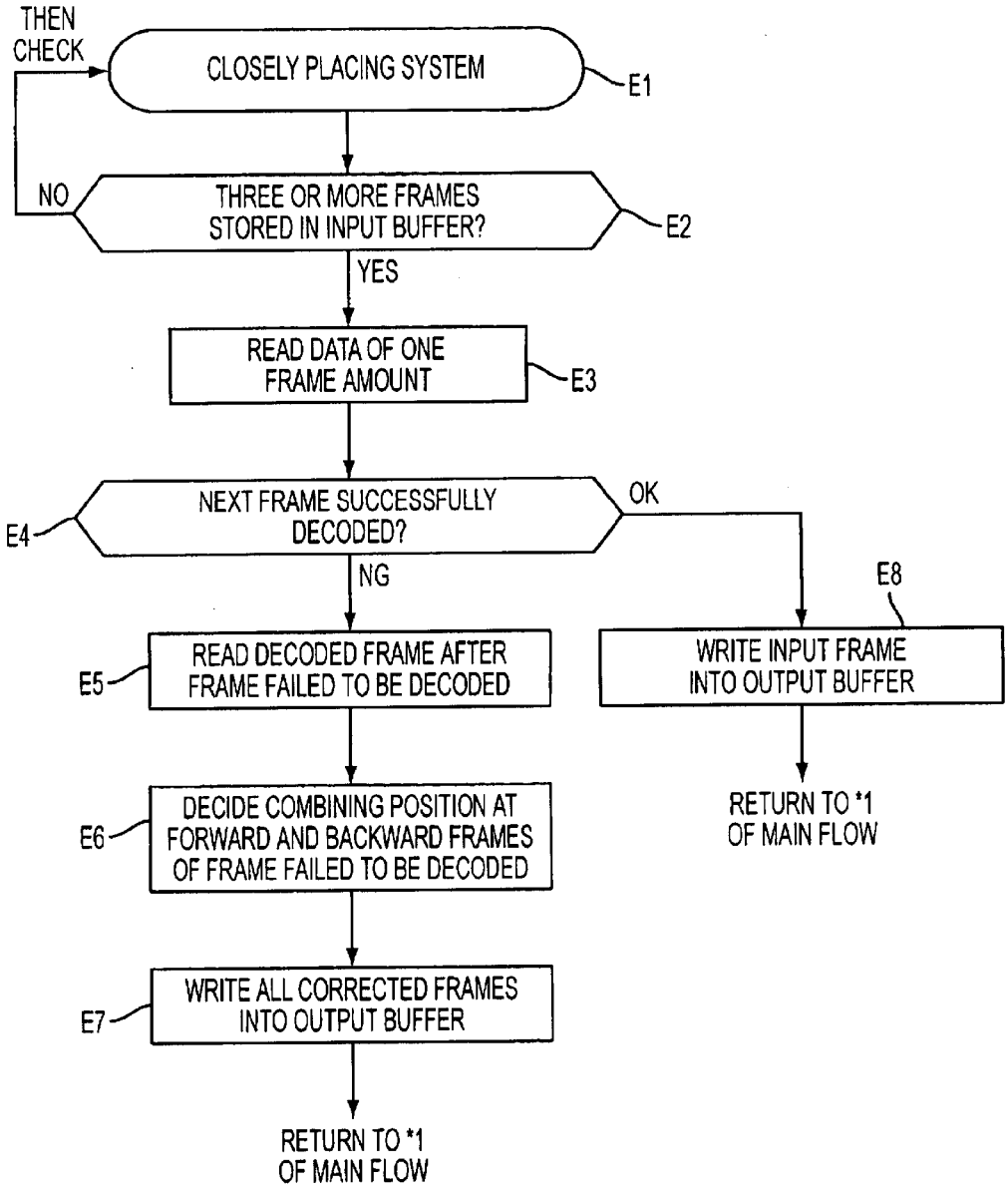
FIG. 16 is a flowchart demonstrating processing in which the failing digital audio information contained in a frame which has failed to be decoded is deleted and the forward and backward frames are placed close to each other.

If the audibility correction system is set such that a frame is deleted and neighboring frames are placed close to each other, the processing goes to the NO route at step A3 and the YES route of step A4 to carry out an audibility correction in which a frame is deleted and neighboring frames are brought close to each other (see processing flow of FIG. 16).

If the audibility correction system is set such that a frame is deleted, neighboring frames are placed close to each other and the time lag caused from the operation for placing the neighboring frames close to each other is compensated by interpolating time adjusting data at a proper position of frame selected after the deleted frame (this method will be described later on), the processing takes the NO route at step A4 and goes through the YES route of step A5, whereby a frame is deleted, such that neighboring frames are placed close to each other, and a frame is created and inserted at a vacant frame position to correct the audibility (see processing flow of FIG. 18).

If the audibility correction system has been otherwise set, the processing takes the NO route at step A5 in which the processing is brought into a mode for awaiting one or more frames stored in the input buffer 13 (step A6). If one or more frames are stored in the input buffer 13, data is transcribed from the input buffer 13 to the output buffer 16 (step A7), and then the processing of one loop is completed.

The audibility correcting means 5, 7, 8 may be informed of the number of frames stored in the input buffer 13 in the following manner. That is, when the audibility correcting means 5, 7, 8 stores data in the input buffer 13, a frame leading address of the data in the input buffer is written in another memory at such a time. Alternatively, the audibility correcting means 5 partitions the memory region of the input buffer 13 into pages each of which has a capacity large enough to store the maximum data amount of one frame length, and not more than data of one frame amount is written in the one page region of the input buffer in one example. Then, an interrupt is effected on the microprocessor 14 each time one frame amount of data has been written in the one page region.

Now, the flows of the correcting processing carried out by the audibility correcting means 5 using the forward frame, the backward frame and both of the frames will be described with reference to FIGS. 12 to 14.

Figure 12:
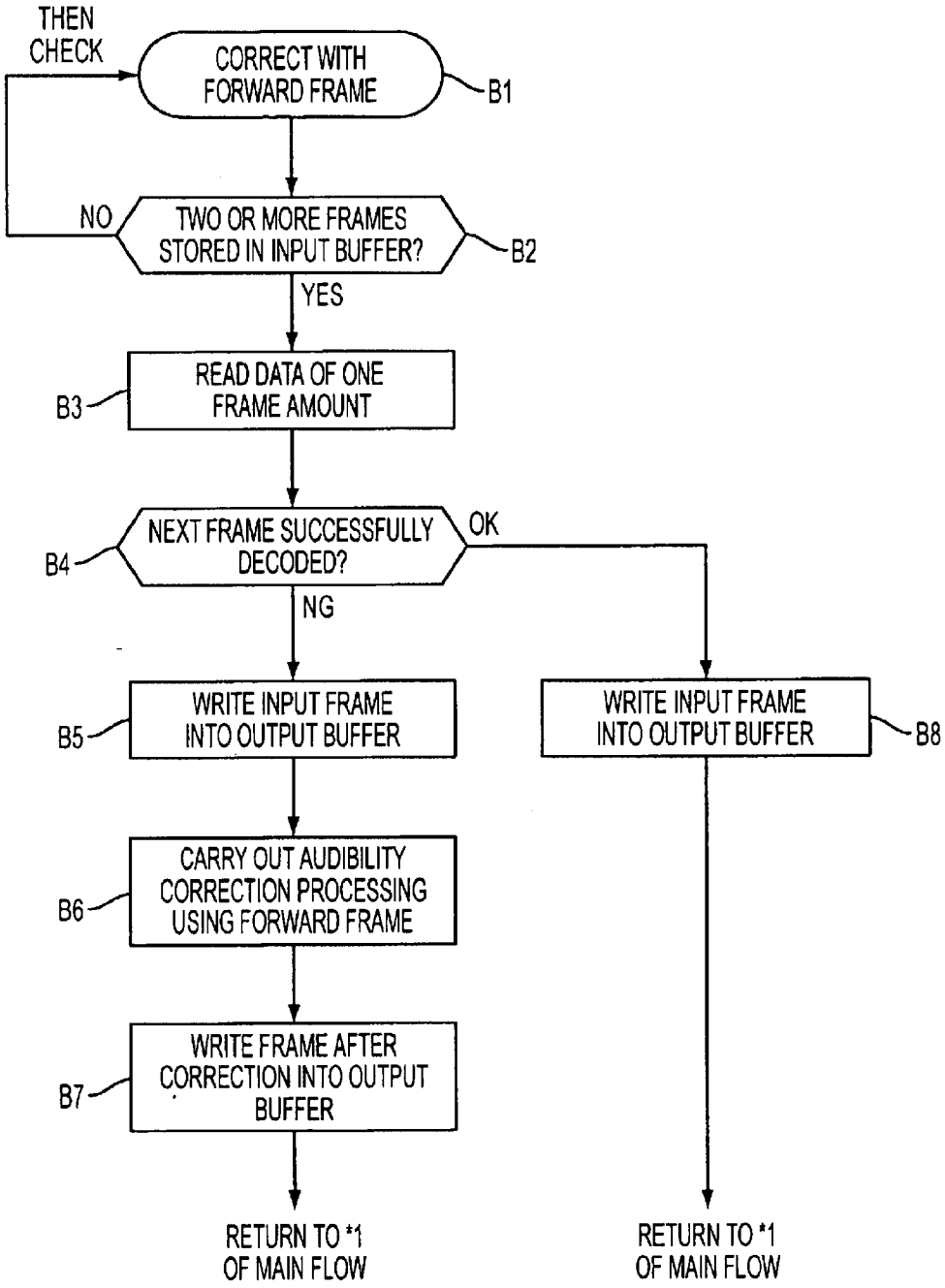
FIG. 12 is a flowchart of a correction process using the forward frame.

As shown in FIG. 12, a flowchart of a correcting processing using the forward frame proceeds such that when the correcting processing using the forward frame is started (step B1), initially, the audibility correcting means 5 waits at step B2 until two or more frames are stored in the input buffer 13.

That is, the audibility correcting means 5 effects buffering on a frame that has been received in the stage preceding by one frame. Under this condition, the next frame is received. If two or more frames are stored in the input buffer 13, the audibility correcting means 5 takes YES route at step B2, and data of the first frame is read (step B3). If the next frame is successfully decoded (decoding OK), the processing proceeds to step B4 in which the OK route is taken. In this route, the input frame is written into the output buffer 16 (step B8) and the processing returns to *1 point of the main flow shown in FIG. 11.

Conversely, if the next same is failed to be decoded (decoding NG), the audibility correcting means 5 selects NG route at step B4, in which the input frame is written into the output buffer 16 (step B5). Then, the audibility correcting processing using the forward frame is carried out (step B6), the frame after the correcting processing is written into the output buffer 16 (step B7) and the processing returns to the *1 point of the main flow as shown in FIG. 11.

Figure 13:
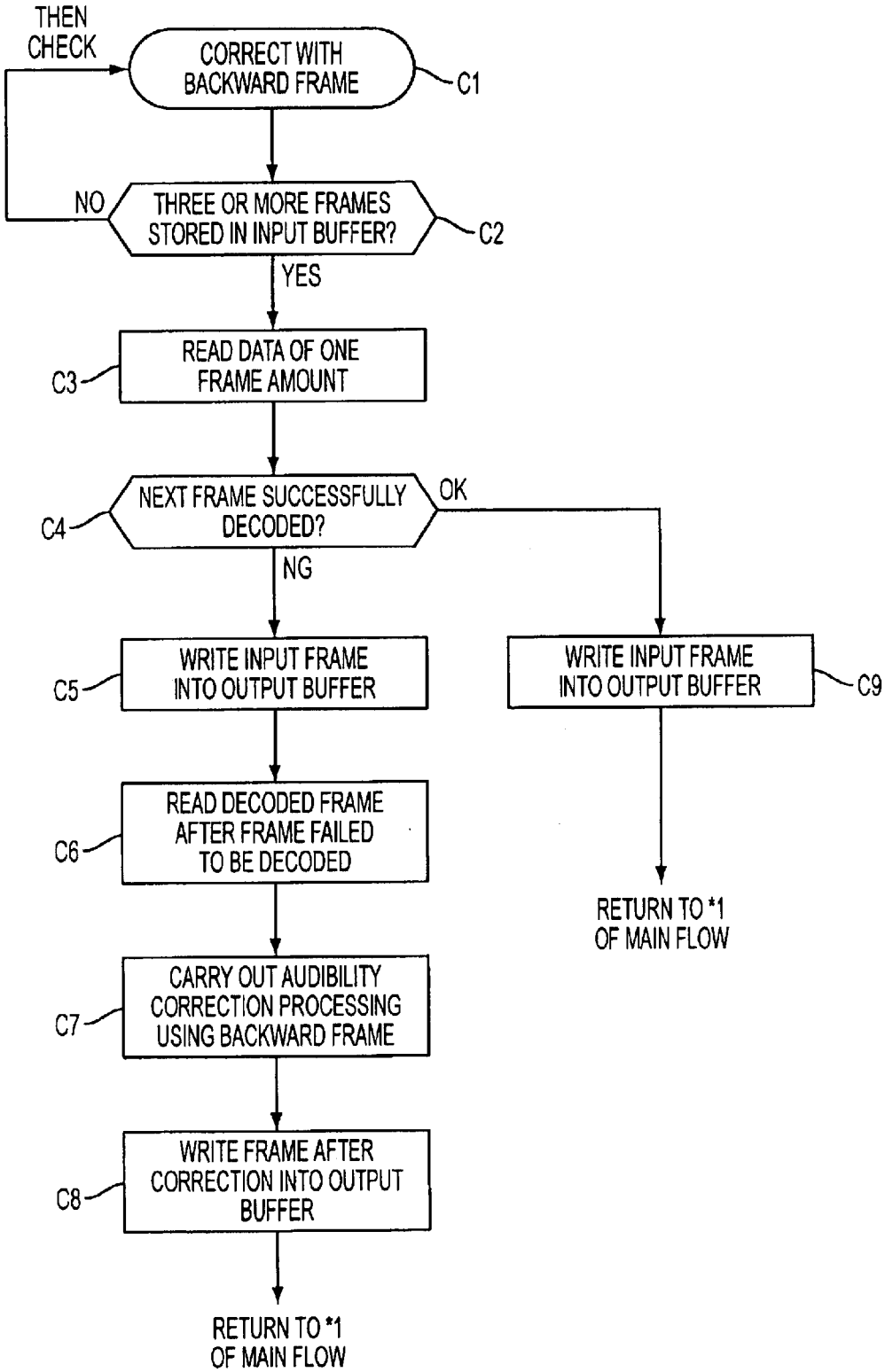
FIG. 13 is a flowchart of the correction process using the backward frame.

FIG. 13 is a flowchart of the correcting processing using the backward frame in one example. As shown in FIG. 13, when the correcting process using the backward five is started (step C1), initially, the audibility correcting means 5 waits at step C2 until three or more frames are stored in the input buffer 13. That is, the audibility correcting means 5 effects buffering on a frame that has been received in the stage preceding by the second frame, and a frame that has been received in the stage preceding by one frame. Under this condition, still another frame is received. If three or more frames are stored in the input buffer 13, the audibility correcting means 5 takes the YES route at step C2, and then reads the data of the frame in the stage preceding by the second frame (step C3). If the next frame that has been received in the stage preceding by one frame is successfully decoded (decoding OK), the processing proceeds to step C4 in which the OK route is taken. In this route, the input frame is written into the output buffer 16 (step C9) and the processing returns to *1 point of the main flow shown in FIG. 11.

Conversely, if the frame preceding one frame amount fails to be decoded (decoding NG), the audibility correcting means 5 selects NG route at step C4, in which the input frame is written into the output buffer 16 ( step C5). Then reading (step C6) the decoded frame which has successfully been decoded after the frame that has failed to be decoded, the audibility correcting processing using the backward frame is carried out (step C7), such that the frame after the correcting processing and the next frame are written into the output buffer 16 (step C8) and the processing returns to *1 point of the main flow shown in FIG. 11.

Figure 14:
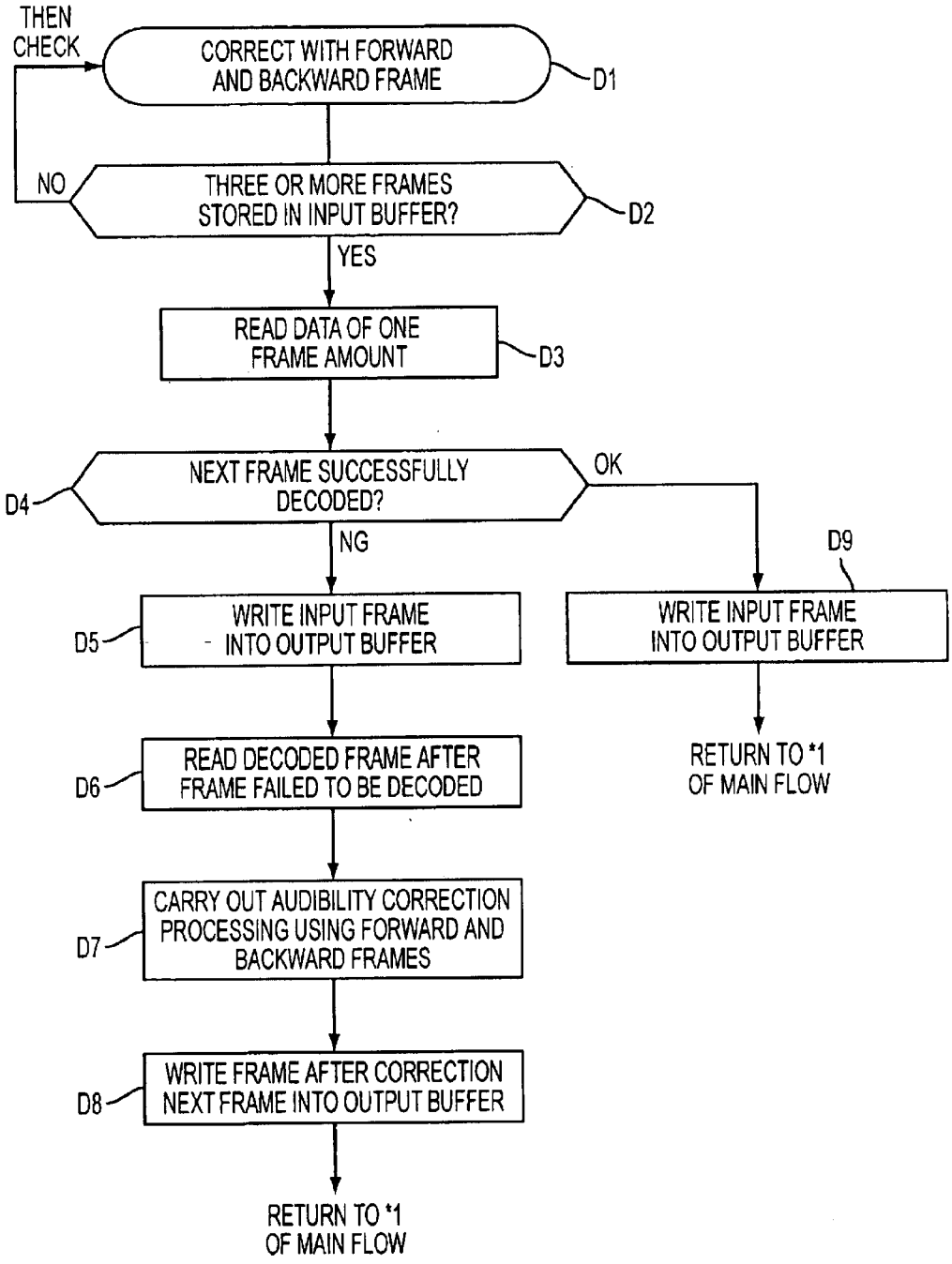
FIG. 14 is a flowchart of the correction process using the forward and backward frames.

FIG. 14 is a flowchart of the correcting processing using the forward and backward frames. As shown in FIG. 14, when the correcting processing using the forward and backward frames is started (step D1), initially, the audibility correcting means 5 waits at step D2 until, for example, three or more frames are stored in the input buffer 13. That is, the audibility correcting means 5 effects buffering on a frame that has been received in the stage preceding by two frames, and for a frame that has been received in the stage preceding, by one frame. Under this condition, still another frame is received. If three or more frames are stored in the input buffer 13, for example, the audibility correcting means 5 takes the YES route at step D2, and the data of frame that has been received in the stage preceding by two frames is read (step D3). If the next frame that has been received in the stage preceding by one frame is successfully decoded (decoding OK), the processing proceeds to step D4 in which the OK route is taken. In this route, the input frame is written into the output buffer 16 (step D9) and the processing returns to *1 point of the main flow shown in FIG. 11.

Conversely, if the frame preceding one frame amount fails to be decoded (decoding NG), the audibility correcting means 5 selects the NG route at step 4, in which the input frame is written into the output buffer 16 (step D5). Then, the decoded frame successfully decoded after recalling the frame which has failed to be decoded (step D6) so that the audibility correcting processing using the forward and backward frames is carried out (step D7), with the frame after the correcting processing and the next frame written into the output buffer 16 (step D8) and the processing returns to *1 point of the main flow shown in FIG. 11.

According to the audibility correction processing steps shown in the flowcharts of FIGS. 12 to 14 (step B6 in FIG. 12, step C7 in FIG. 13, step 17 in FIG. 14), the smoothing processing means 5*a* carries out a smoothing processing so that noise is eliminated and sound reproduction is achieved with a naturalistic sounding continuous flow in terms of audibility for a receiver to enjoy.

In this manner, the digital audio reproducing apparatus 10 has the audibility correcting means 5 which executes the audibility correction by using the forward digital audio information, the backward digital audio information as well as both the forward and backward digital audio information. Therefore, broadcasting radio wave and reproduction of the same can be carried out by a simple manner without expensive investment such as a gap filler 54 or the like. Moreover, since the geostationary satellite 51 need not arrange transmission data in a redundant manner, the radio wave frequency band can better be effectively utilized.

Furthermore, with the above-described smoothing carried out, the receiver can enjoy a naturalistic sound achieved with a simple apparatus, at low cost.

As described above, according to the first mode of the embodiment, the audibility correcting processing is carried out in a simple manner by the digital audio reproducing apparatus 10 on the receiving side. Therefore, the audibility correction can be carried out satisfactorily from a practical standpoint. Further, it is possible to keep transmitted radio wave reproduction regardless of occurrence of the broadcasting breaks due to interception in radio wave transmission, without needing an increasing number of gap fillers 54 or relaying stations. Accordingly, investment cost can be reduced.

The audibility correcting process carried out by the audibility correcting means 7 of the second mode will hereinafter be described. The second mode is a method such that when digital audio information has failed to be decoded, the failing digital audio information accommodated in the frame failed to be decoded is deleted to effect the audibility correction. According to the method there are two possible manners to carry out the audibility correction for example. A first example is one in which the failing digital audio information is deleted and audio data received after the frame failed to be decoded is placed close to the deleted frame position. A second example is one in which the failing digital audio information is deleted and audio data is created by synthesizing the forward frame and backward frame such that the vacant frame position caused from the deletion of the frame is "stuffed" with the created audio data.

Hereinafter a method of correction will be described in which a lost data frame is deleted and following received data frame is placed close to the position at which the data deletion is effected, with reference to FIGS. 15(*a*) to 15(*c*) and FIG. 16. Then, a method of data correction in which lost data is deleted and a data frame is created by synthesizing the forward and backward data frames by inserting at the position at which the data deletion is effected will be described with reference to FIGS. 17(*a*) to 17(*c*) and FIG. 18.

FIGS. 15(*a*) to 15(*c*) show the method of correction in which a lost data frame is deleted and following received data frame is placed close to the position at which the data deletion is to be effected. An audio stream 25 derived from demultiplexing the received data shown in FIG. 15(*a*) is via a received data frames containing program data arrayed in a chronological sequence. The audio stream 25 lacks several data frames due to the radio wave break in a transmission path.

FIG. 15(*b*) is the audio data after the decoding processing. As shown in FIG. 15(*b*), a frame N at a frame position 25*a* is normally received, and frames N+2, N+4, N+5, N+6, at frame positions 25*c*, 25*e*, 25*f*, 25*g* are also normally received, respectively. Conversely, frames corresponding to a frame number N+1 at a frame position 25*b* and a frame number N+3 at a frame position 25*d* are lost.

As shown in FIG. 15(*c*), the audibility correcting means 7 deletes the frames placed at the frame positions 25*b*, 25*d* and places the following received frames N+2, N+4, N+5, N+6 close to the vacant positions caused by the deletion. Thus, corrected data 25' is created. Then, the second smoothing processing means 7*a* within the audibility correcting means 7 carries out smoothing processing on the boundaries between the pieces of digital audio information neighboring the failing digital audio information caused by deleting the failing digital audio information.

In this case, in order to avoid a time lag deriving from the operation for shifting the following frames close to the position the deleted frame has been located, time adjusting data is inserted to recover the lost time equivalent to the deleted frame amount at a proper position of the series of the following frames. How the position at which the time adjusting data is inserted is determined will be described later on.

Now, a flowchart of a process carried out by the audibility correcting means 7 will be described with reference to FIG. 16.

FIG. 16 is a flowchart of an example of when the process in which the audio decoding unit 4 fails to decode the above-mentioned digital audio information, the failing digital audio information contained in the frame failed to be decoded is deleted and the forward and backward frames are placed close to each other. As shown in FIG. 16, when the processing is started (step E1), initially the audibility correcting means 7 waits at step E2 until three or more frames are stored in the input buffer 13. In effect, the audibility correcting means 7 provides buffering on a frame that has been received in the stage preceding by, in this example, two frames and a frame that has been received in the stage preceding by one frame. Under this condition, still another frame is received. If three or more frames are stored in the input buffer 13, the audibility correcting means 7 takes the YES route at step E2, and reads data of the frame that has been received in the stage preceding by two frames (step E3). If the next frame that has been received in the stage preceding by one frame is successfully decoded (decoding OK), the processing proceeds to step E4 in which the OK route is taken. In this route, the input frame is written into the output buffer 16 (step E8) and the processing returns to *1 point of the main flow shown in FIG. 11.

Conversely, if the frame preceding one frame amount fails to be decoded (decoding NG), the audibility correcting means 7 selects the NG route at step E4, in which the decoded frame successfully decoded after the frame failed to be decoded is read (step E5). At step E6, the forward and backward frames of the frame failed to be decoded are placed close to each other so that noise is eliminated and sound can be reproduced in a naturalistic continuous, audible form.

In order that the audibility correcting means 7 can deal with a situation in which a frame of every other position fails to be received, the audibility correcting means 7 is arranged not to output data of one frame amount from the last but to leave the data in the input buffer, at step E7 and step E8 of FIG. 16.

In order that the connection between the frames causes naturalistic, continuous sound reproduction from an audibility standpoint, the weighting and adding processes shown in FIG. 10 is carried out. Further, the second smoothing process means 7*a* caries out smoothing processing on the boundaries between the pieces of digital audio information neighboring the failing digital audio information caused by deleting the failing digital audio information. Therefore, sound can be reproduced in a more naturalistic continuous fashion.

When the corrected frames are all written into the output buffer 16 at step E7 in FIG. 16, the processing returns to *1 point of the main flow of FIG. 11.

Further detail of the above-mentioned two manners, i.e., the manner in which the failing digital audio information is deleted and audio data is created by synthesizing the forward and backward frames of the deleted frame and inserted at the position at which the deletion is effected, follows.

Figure 17A:
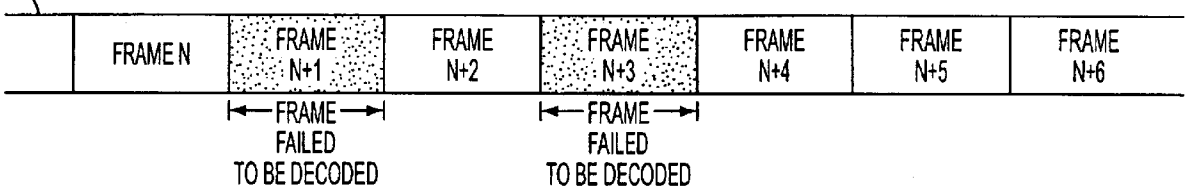
FIG. 17(*a*) is a diagram demonstrating a demultiplexed received audio stream.
Figure 17B:
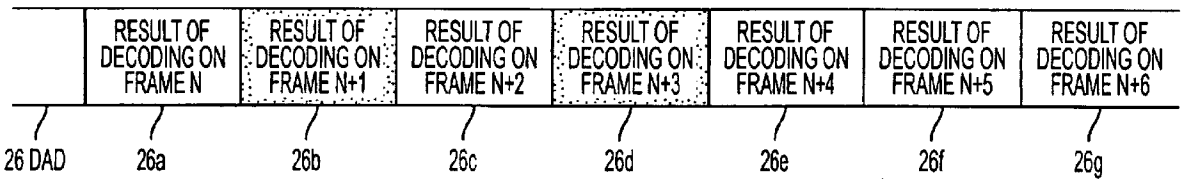
Figure 17C:
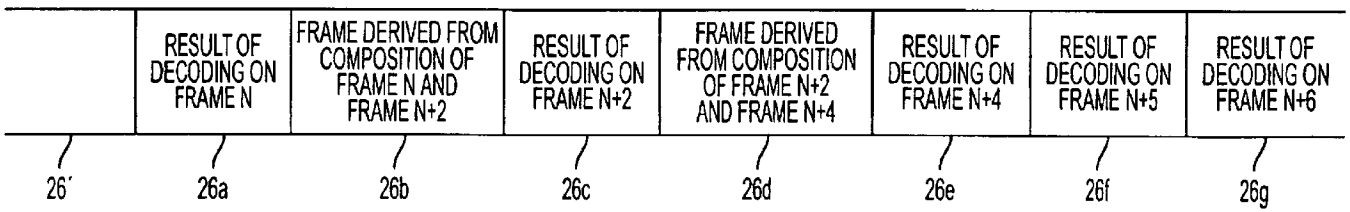

FIGS. 17(*a*) to 17(*c*) show a manner in which the lost data frames are deleted and new data frames of which number corresponds to the number of deleted frames are created. An audio stream 26 deriving from a demultiplexing operation shown in FIG. 17(*a*) is a series of received data frames containing program data. Similarly to the example described above, the audio stream 26 lacks several data frames due to the radio wave breaks in transmission path. As shown in FIG. 17(*b*), The audio stream 26 having been decoded lacks, for example, two data frames at frame positions 26*b*, 26*d*. Therefore, audio data 26 containing frames N, N+2, N+4, N+5, N+6 positioned at frame positions 26*a*, 26*c*, 26*e*, 26*f*, 26*g* is supplied to the audibility correcting means 7.

The audibility correcting means 7 creates frame data by synthesizing the frame N and the frame N+2 and inserts the created data into the data dropped position 26*b* shown in FIG. 17(*b*). Also, the audibility correcting means 7 creates frame data by synthesizing the frame N+2 and the frame N+4 and inserts the created data into the data dropped position 26*d* shown in FIG. 17(*b*). In this way, corrected data 26' is produced.

That is, the audibility correcting means 7 deletes the frame corresponding to the frame number N+1 located at the fine position 26*b* shown in FIG. 17(*b*), and creates new data by synthesizing a part of the forward frame N and a part of the backward frame N+2 and insets the created data into the audio stream at the frame position 26*b*. Further, the audibility correcting means 7 deletes the frame corresponding to the frame number N+3 located at the frame position 26*d*, and creates new data by synthesizing a part of the forward frame N+2 and a part of the backward frame N+4 and inserts the created data into the audio stream at the frame position 26*d*. The processing carried out by the audibility correcting means 7 is similar to that of FIG. 16. Therefore, further explanation will not be provided.

Since it is requested to connect frames to each other so as to attain naturally continuous sound reproduction from an audibility standpoint, the above-described weighting and adding processing is carried out.

According to the weighting and adding processing, the frame length of data to be placed close to the deleted position or the frame length of the data to be inserted into the deleted position is made to have a constant length and arranged to be capable of canceling influence caused from non-similarity between connected data frames even if they are not similar to each other in terms of audio signal. In order to attain more naturalistic sound continuity from an audibility standpoint, a part of audio signal (e.g., last position) of a frame before the deleted frame and a part of audio signal having a high correlation (great similarity) of a frame following the deleted frame may be connected to each other.

That is, when the audibility correcting means 7 deletes the failing digital audio information and places the pieces of the digital audio information neighboring the failing digital audio information close to each other, the pieces of the digital audio information neighboring the failing digital audio information may be brought to connect with each other at respective positions most coincident to each other in audio signal level. Thus, achieving correction of the audibility of the original. Alternatively, the pieces of the digital audio information neighboring the failing digital audio information may be brought into connection with each other at respective positions most coincident to each other in both the audio signal level and the slope of the same. Thus, audibility correction is achieved.

At the same time, the second smoothing processing means 7*a* effects smoothing on the boundary between the pieces of the digital audio information neighboring the failing digital audio information and caused by deleting the failing digital audio information. The smoothing operation achieves a sound reproduction in a naturalistic, continuous and better audible form.

When the frames are connected to each other at respective positions most coincident to each other, one of the connecting positions is selected from the midway of the following frames in our example. Therefore, the overall frame length is made short. Due to this fact, a time lag is caused between the timing of the program data broadcast by the broadcasting station 50*a* and the timing of the data having been subjected to the correction processing. In order to correct the time lag there between the time adjusting data is inserted into the following frames to cancel the time lag.

When the time adjusting data is inserted into the data frame series, the inserted data is harmonized with the original audio data and not conspicuous in the audio reproduction. To this end, the time adjusting data is inserted into the data frame series at a position where the sound volume is small in measure. Alternatively, the time adjusting data is inserted into the data frame series to be assimilated with the neighboring audio signal such that the inserted data is made inconspicuous.

Reiterating, the time adjusting data inserting means 7*b* inserts 0-level data or minute level data at a position having a small audio signal level. Alternatively, the time adjusting data inserting means 7*b* creates time adjusting data from the pieces of digital audio information neighboring the failing digital audio information.

Hereinafter, the time adjusting data processing carried out by the audibility correcting means 7 will be described with reference to the flowchart of FIG. 18. According to the processing shown in the flowchart of FIG. 18, the failing digital audio information contained in the frame which has failed to be decoded is then deleted, the neighboring frames are placed close to each other, with time adjusting data inserted to cancel the time lag between the timing of the program data broadcast by the broadcasting station 50*a* and the timing of the correction processed data.

Figure 18:
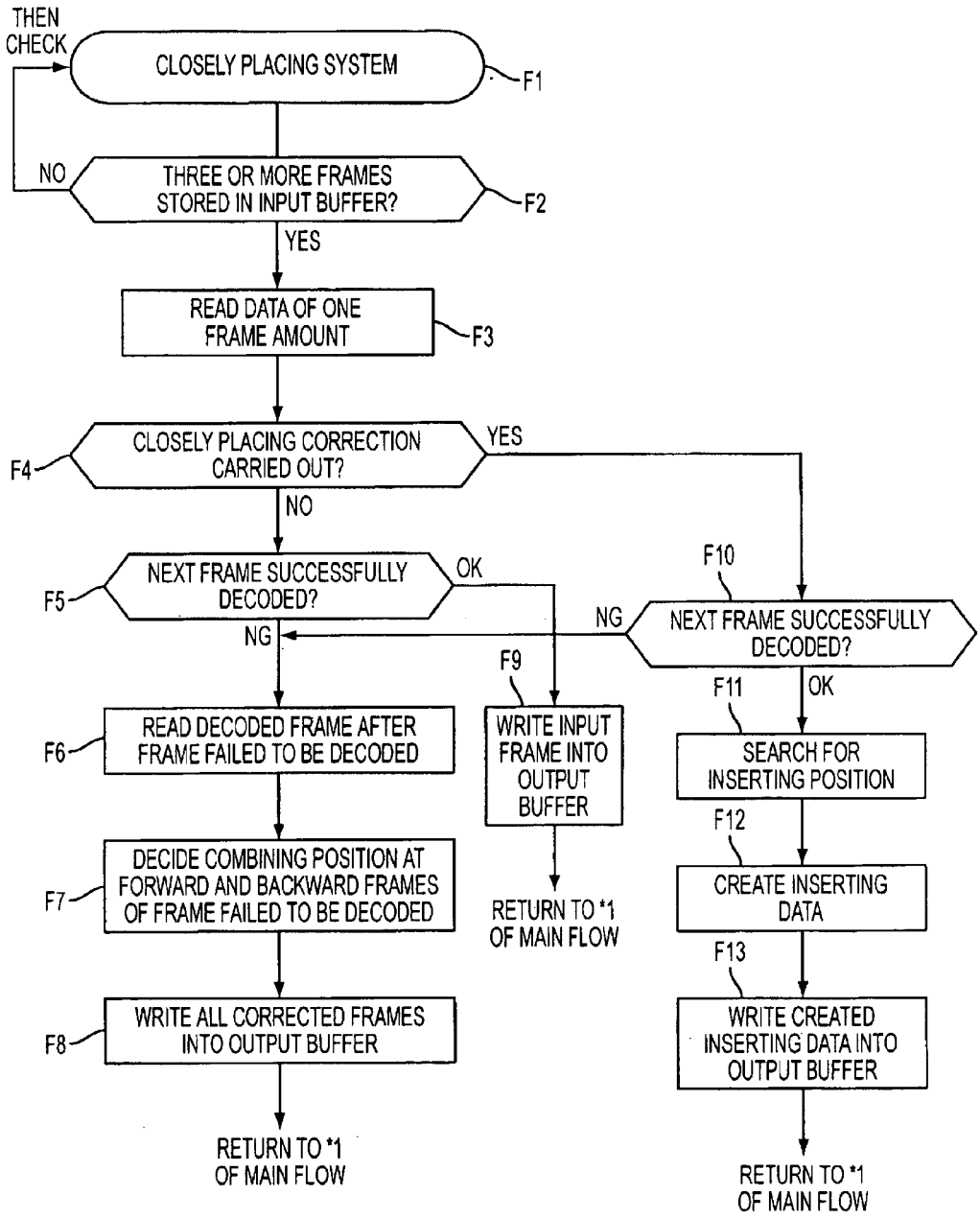
FIG. 18 is a flowchart of a time adjusting data process demonstrating deletion of failing digital audio information contained in a frame which has failed to be decoded, the forward and backward frames are placed close to each other, and the time lag is adjusted.
Figure 19A:
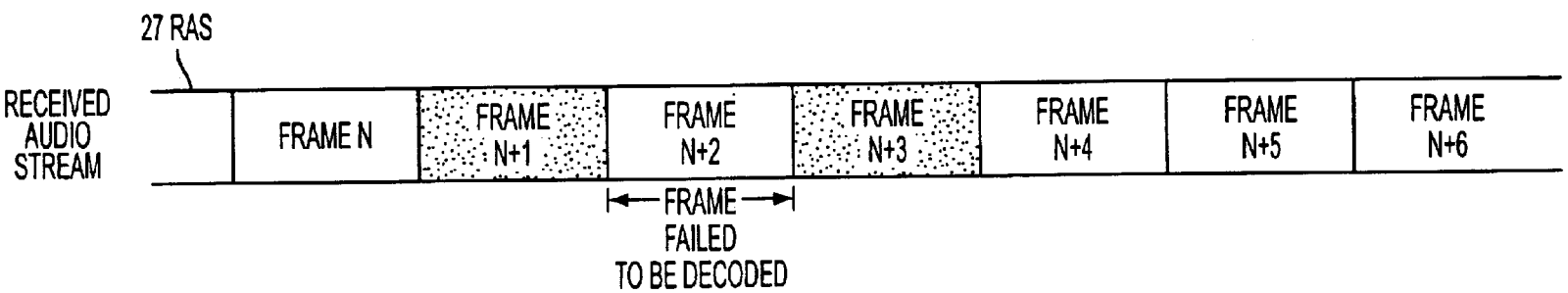
FIG. 19(*a*) is a diagram demonstrating a demultiplexed received audio stream.
Figure 19B:
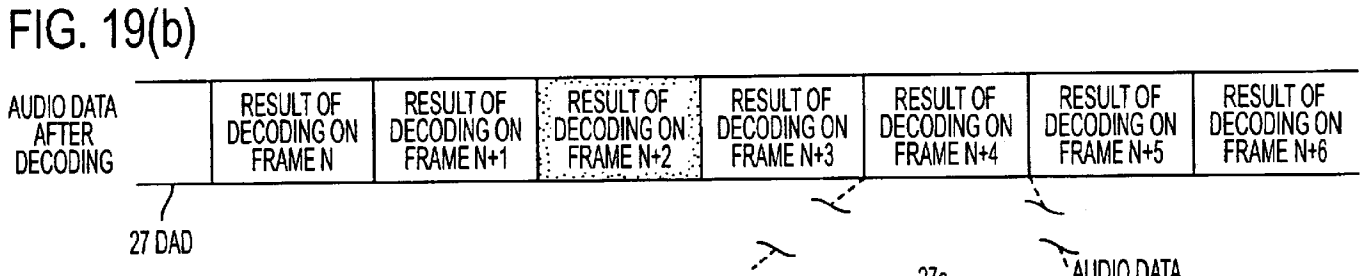
Figure 19C:
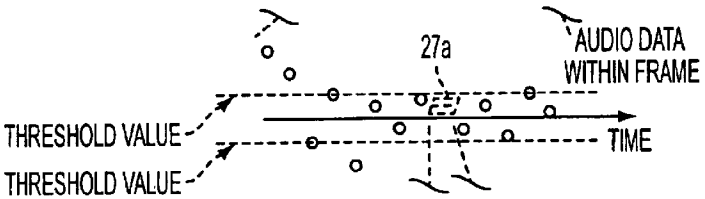
Figure 19D:
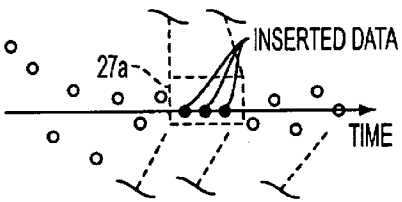
Figure 19E:
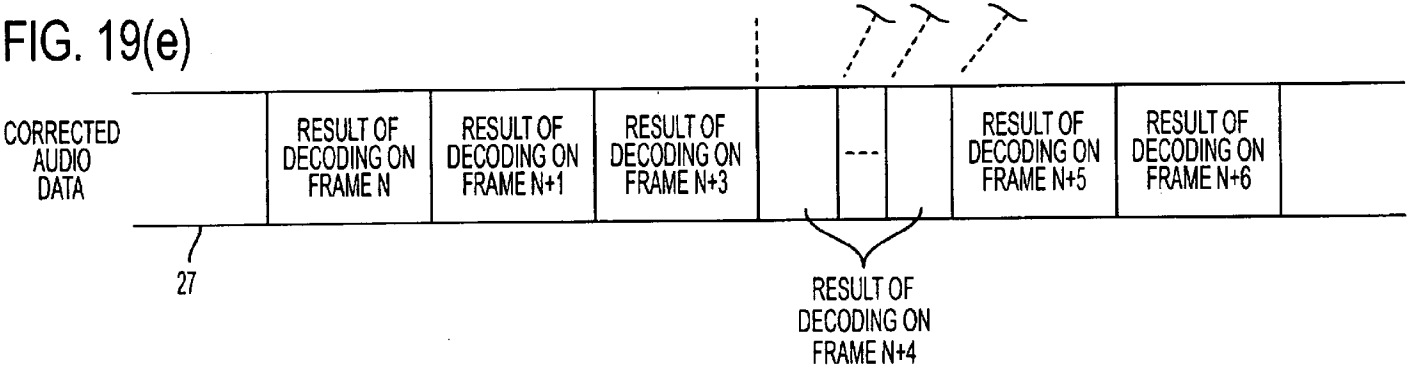

Described further is the flowchart of FIG. 18 with reference to the frame arrangement shown in FIG. 17. FIG. 17(*b*) shows a frame arrangement of the audio data 26 subjected to the decoding processing. The series of data frames lack frames of frame numbers N+1 and N+3, corresponding to the frame positions 26*b* and 26*d*, respectively. Following is a description of the method in which frames neighboring the frame position 26*b* are placed close to each other, and the frame data is inserted.

As shown in FIG. 18, when processing is started (step F1), initially the audibility correcting means 7 waits at step F2 until three or more frames are stored in the input buffer 13. That is, the audibility connecting means 7 effects buffering on a frame that has been received in the stage preceding by two frames and a frame that has been received in the stage preceding by one frame. Under this condition, still another frame is received. If three or more frames are stored in the input buffer 13, the audibility correcting means 7 takes the YES route at step F2, and reads the data of the frame that has been received in the stage preceding by two frames(frame N in FIG. 17(*b*))(step F3). At step F4, it is confirmed if the operation in which the frames neighboring the deleted frame are placed close to each other has been taken or not. If the operation has not been taken, then the NO route of step F4 is selected and the next frame received in the stage preceding by one frame (frame N+1 of FIG. 17(*b*) is then decoded. At this time, since the frame is dropped, the audibility correcting means 7 takes the NG route of step F5, and at step F6 reads the frame following the frame which has failed to be decoded (frame N+2 of FIG. 17(*b*)). If the frame is successfully received, the OK route is taken at step F5, and the input frame is written into the output buffer 16 (step F9) and the processing returns to the *1 point of the main flow shown in FIG. 11.

Then, at step F7, the audibility correcting means 7 places the forward and backward frames of the frame which has failed to be decoded (frame N and frame N+2 of FIG. 17(*b*)) close to each other in a similar manner to the one described earlier, and then increments the count of a counter by +1 such that it can be determined whether the frame position represents an accurate time or not. If the audibility correcting means 7 inserts a frame into the series of frames, the count of the counter is decremented by −1. In this way, the accuracy of the timing is achieved by observing the count of the counter. For example, if the count of the counter is zero, this fact means that the processing for placing the frames close to each other has not been taken yet, or the processing for placing the frames close to each other and processing for inserting the frame into the series of frames cancel the incremented value and the decremented value by each other as a consequence.

Corrected frames are all written into the output buffer 16 (step F8) and the processing returns to the *1 point of the main flow shown in FIG. 11.

Thereafter, the processes of step F1 and step F2 of FIG. 18 are carried out. At step F3, the data of frame position 26*b*, in which synthesized data is stored, is read. At step F4, the audibility correcting means 7 detects the count of the counter of a positive value (+1) meaning that the processing for placing the frames close to each other has been done. Thus, the audibility correcting means 7 takes the YES route and at step F10, data of the frame position 26*c* is carried out. In this case, since the data of the frame position 26*c* is decodable, the OK route of step F10 is taken At step F11, the time adjusting data inserting means 7*b* searches a frame following the frame position 26*b* (e.g., the frame N+2 of FIG. 17(*b*)) for a position suitable for inserting the newly created time adjusting data. That is, since the processing for placing the frames close to each other has been done before the frame N+2, a time lag equivalent to one frame amount is created. Therefore, time adjusting data is inserted to make the timing of the series of frames and timing of the program data broadcast by the broadcasting station 50*a* coincident to each other. Then, the audibility correcting means 7 creates the data to be inserted at step F12 and writes the created data into the output buffer 16 at step F13. Thereafter, the processing returns to *1 point of the main flow shown in FIG. 11. If the next frame is not successfully decoded at step F10, i.e., at least two consecutive frames have failed to be decoded, then the NG route is taken and processing of step F6 and the following steps are carried out.

In order that the audibility correcting means 7 can deal with a situation in which a frame of every other position has failed to be received, the audibility correcting means 7 is arranged not to output data of one frame amount from the last but to leave it in the input buffer, at step F8 and step F13 of FIG. 18.

According to the above arrangement, for example, the audibility correcting means 7 can connect two audio signals at an optimum position with high correlation in terms of audibility, unlike in the case in which two audio signals are merely subjected to a weighting and adding process. Further, carried out simultaneously are not only the processing for placing the frames close to each other but also processing for adjusting the timing of corrected frame series relative to the timing of the broadcast program. Therefore, it is possible to follow in real time the broadcast program.

Owing to the correcting processing, even if the mobile receiving terminal goes into a shaded area, sound reproduction with no interruption can be satisfactorily achieved of a practical, audible quality with a simply arranged apparatus. Therefore, the expensive equipment such as the gap filler 54 shown in FIG. 2 need not be used and the transmission system can be achieved at a low cost. Further, since the above-described smoothing is carried out at step F7, the receiver of the broadcast program can enjoy sound of a naturalistic, continuous audible quality from a simple apparatus, and at a low cost.

Hereinafter, an example of inserting the time adjusting data will be described with reference to FIGS. 19 to 22.

Initially, the manner in which 0-level data is inserted at a position having a small audio signal level will be described with reference to FIGS. 19(*a*) to 19(*e*). FIG. 19(*a*) shows an audio stream 27 derived from the demultiplexing operation. The audio stream 27 is composed of received data frames containing program data and lacks frame data corresponding to the frame number N+2 due to the radio wave breaks in transmission path.

FIG. 19(*b*) is a diagram explaining audio data after the decoding processing. Data which has failed to be decoded is deleted, as described above, and the frame position of the frame N+2 is "stuffed" with data of the frame N+3. At the same time, time adjusting data is inserted into the frame series at the position of frame N+4.

FIG. 19(*c*) is a diagram showing a magnified view of the frame N+4. As shown in FIG. 19(*c*), the frame N+4 contains within its frame discrete audio data each represented by a blank small circle arrayed in a time sequential fashion. A threshold value is prepared for such audio data on each of the positive and negative sides of the signal level. If the number of discrete data falling within the range sandwiched by the threshold values exceeds a predetermined number, as shown in FIG. 19(*d*), then it is determined that the position is suitable for data insertion, and 0-level data 27*a* is inserted into the audio data falling within the range. Such that, as shown in FIG. 19(*e*), the frame N+4 is elongated by the length of the 0-level data, resulting in the corrected data 27' also being elongated correspondingly. In this manner, the time lag caused by deletion of the audio data can be corrected.

These discrete audio data take a form of series of values each having a sign. For example, audio data having a tone quality substantially equivalent to that of a compact disk is composed of 16-bit data, and the time interval at which such discrete audio data are arrayed is 1/44.1 kHz (22.676 μsec). The level at which the threshold value is set and the number of discrete data falling within the range between the threshold values at which 0-level data insertion is started, may be arbitrarily selected depending on the application utilized.

Figure 20A:
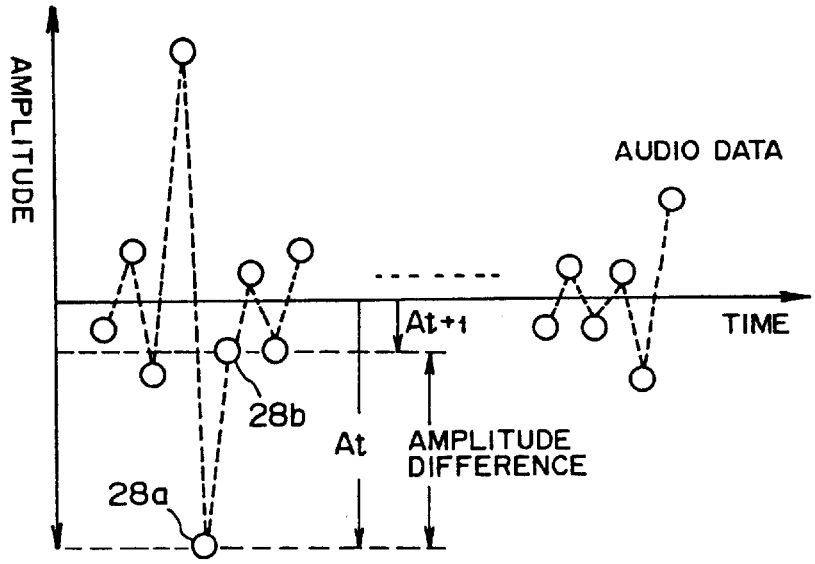
FIG. 20(*a*) is a diagram demonstrating original audio data.
Figure 20B:
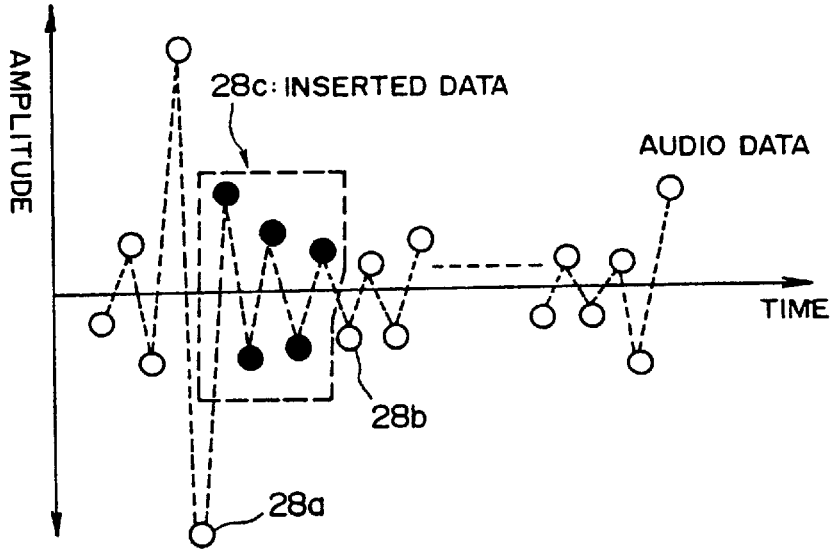

FIGS. 20(*a*) and 20(*b*) show the method in which time adjusting data is inserted into the series of frames at a position having an abrupt signal level change. As shown in FIG. 20(*a*), the original audio data represented by a blank small circle with the frame are arrayed in a time sequential fashion. The time adjusting data inserting means 7*b* calculates a value representing the change in amplitude between adjacent discrete audio data, sequentially. For example, if At is taken as the amplitude value of the audio data 28*a* at the time t and At+1 is taken as the amplitude value of the audio data 28*b* at the time t+1, the time adjusting data inserting means 7*b* calculates the volume ratio in an absolute form by dividing the volume value of At+1 of the large volume portion by the volume value of At of the small volume portion. If the changing rate of the absolute value exceeds a certain value (e.g., a first set value), the position can be regarded as a position suitable for insertion. As shown in FIG. 20(*b*), the time adjusting data inserting means 7*b* inserts the time adjusting data 28*c* between the audio data 28*a* and 28*b* so that the inserted data is assimilated with the neighboring audio data. The amplitude value is created from the audio data 28*b* that is of a small volume portion, and the created data is inserted at the side of the small volume portion.

The rate of the absolute value change may be calculated and determined by a first-order approximation equation produced by connecting a plurality of points. Further, the number of discrete data to be inserted may be arbitrarily determined. As described above, the time adjusting data inserting means 7*b* is arranged to insert the time adjusting data at the position in which the absolute value of the volume change rate of the audio signal becomes larger than the first set value. The time adjusting data is created from digital audio information on the small volume side of both of the neighboring audio information.

When time adjusting data is inserted at the small volume side of the position in which volume change rate is large, noise caused from the data insertion will become relatively small and hence the noise will be masked by the large volume position at a vicinity of the noise in terms of time, with the result that the noise becomes almost not discernible. Accordingly, sound can be reproduced with improved audibility.

Figure 21A:
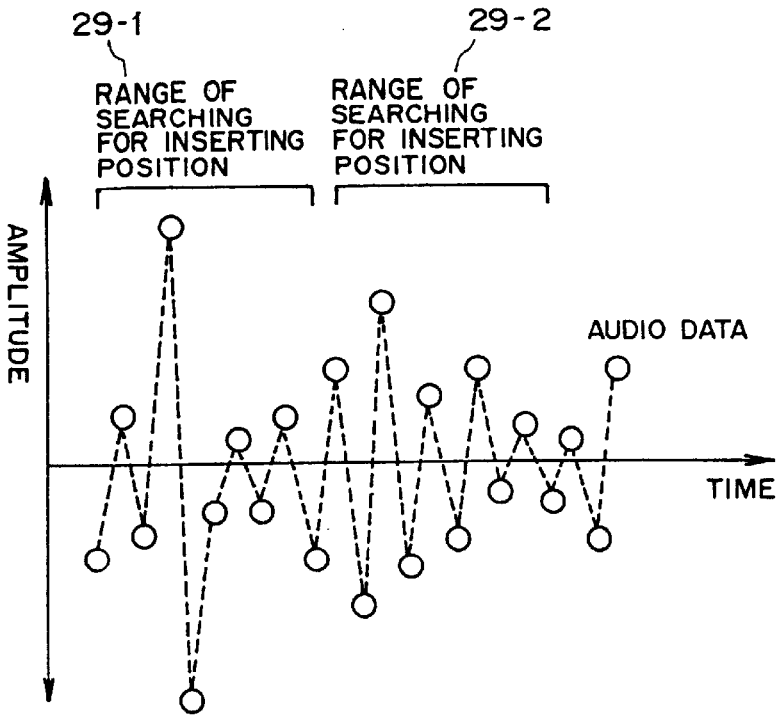
FIG. 21(*a*) is a diagram demonstrating original audio data.
Figure 21B:
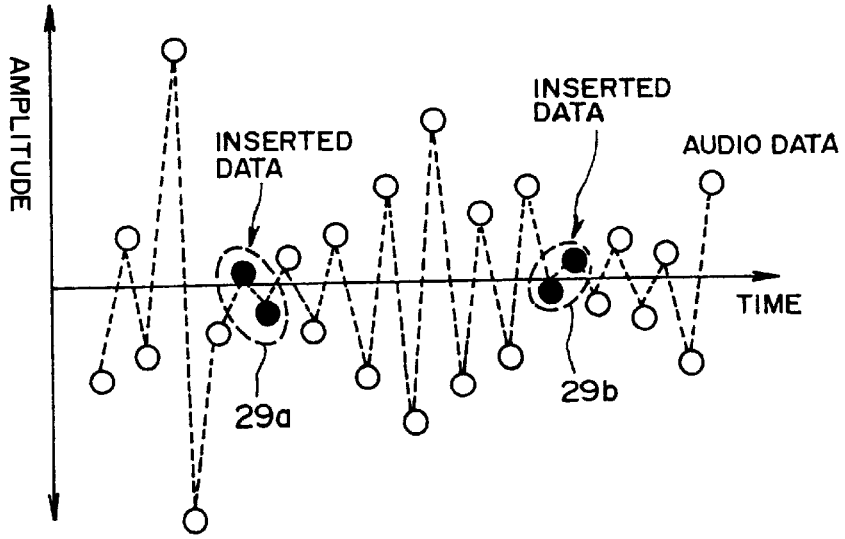

Further, FIGS. 21(*a*) and 21(*b*) show the method in which data is inserted into a certain range of frame series at a position in which the audio volume is small. As shown in FIG. 21(*a*), it is allowable to determine arbitrarily ranges 29-1, 29-2 for searching for a position at which time adjusting data is inserted, with regard to the amplitudes of discrete original audio data represented by blank small circles arrayed in a time sequential fashion within the frame. The time adjusting data inserting means 7*b* searches the ranges for a position at which the absolute value of the amplitude of the audio signal becomes the smallest. Then, as shown in FIG. 21(*b*), the time adjusting data inserting means 7*b* inserts interpolating data 29*a* at the smallest amplitude position within the range 29-1 so that the inserted data is assimilated with the neighboring audio signals in terms of amplitude. Also, the time adjusting data inserting means 7*b* inserts interpolating data 29*b* at the smallest amplitude position within the range 29-2. The number of discrete data to be inserted may be arbitrarily determined. As described above, the time adjusting data inserting means 7*b* is arranged to insert the time adjusting data at the smallest volume portion of the audio signal within a predetermined range which is located after the deleted failing digital audio information. The time adjusting data is created from pieces of digital audio information neighboring the deleted digital audio information.

When time adjusting data is inserted at the small volume portion sequence, the noise becomes inconspicuous because the volume of the inserted noise itself is small. Particularly, if the mobile receiver is operated under an ordinary noise generating environment, the noise caused from insertion becomes almost non-discernible. Accordingly, sound can be reproduced in an improved audible form.

Figure 22A:
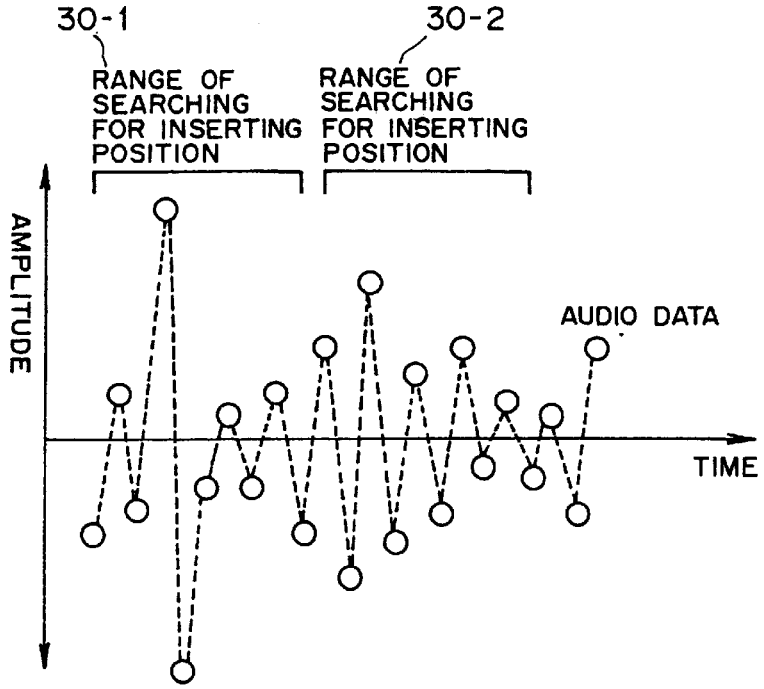
FIG. 22(*a*) is a diagram demonstrating original audio data.
Figure 22B:
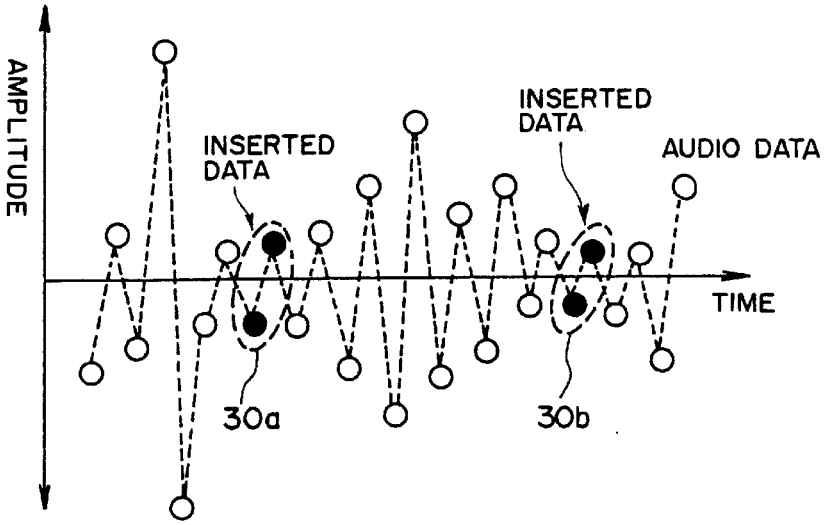

Further, FIGS. 22(*a*) and 22(*b*) show the method in which data is inserted into a certain range of frame series at a position in which the audio volume change rate is small. As shown in FIG. 22(*a*), it is allowable to arbitrarily determine ranges 30-1, 30-2 for searching for a position at which time adjusting data is inserted, with regard to the amplitudes of discrete original audio data represented by blank small circles arrayed in a time sequential form within the frame. The time adjusting data inserting means 7*b* calculates the absolute value of the amplitude of the audio signal sequentially within each of the range so as to detect a portion in which the absolute value changing rate stays within a certain value (second set value). If such a portion is detected, the position is regarded as a place suitable for data insertion□ Then, as shown in FIG. 22(*b*), the time adjusting data inserting means 7*b* inserts interpolating data 30*a* and 30*b* at the position so that the inserted data is assimilated with the neighboring audio signals in terms of amplitude. The number of discrete data to be inserted may be arbitrarily determined.

Further, how the second set value introduced upon the interpolation processing is decided is described. Sound volume waves tend to be heard relative to other sound volume waves from an audibility vantage. For example, when a source (original sound) is reproduced, a listener of the sound tends to listen to the sound at a volume adjusted ultimately at an increasing volume when the reproduced sound is to a small volume level, while the listener tends to listen to the sounds at a volume adjusted ultimately in a decreasing manner when the reproduced sound has a large volume level. Further, it is common that when reproduced sound increases its volume, the listener of the sound tends to choose to listen to sounds at a volume adjusted in an decreasing manner, while when the reproduced sound is of very low volume to decrease the volume, the listener will choose to listen the sound at an increased volume level. When the second set value is decided for specifying a place of frame series in which its volume is small, the above-described volume audibility characteristic is taken into account, so that the set value is determined to have a positive correlation with the volume change amount. That is, the larger the mean value of the volume up to the point soon before the current position (i.e., mean volume value within a predetermined time interval or predetermined number of frames) or an inclined weight distribution value (value derived from processing data in which audio data closer to a current position is set larger while audio data remote from the current position is set smaller) is larger the second set value is set. Conversely, the smaller the mean value of the volume, up to the point soon before the current position, or the inclined weight distribution value is, the smaller the second set value is set. Thus, the second set value is variably set. According to the setting of the second set value, the position suitable for inserting the time adjusting data can be more promptly found, and resulting insertion becomes much less conspicuous.

As described above, the time adjusting data inserting means 7*b* is arranged to search a predetermined range of the frame series after the portion at which the failing digital audio information is deleted, and insert the time adjusting data at a point in which the absolute value of the audio signal volume change becomes smaller than the second set value. At this time, the time adjusting data is created from pieces of digital audio information neighboring the deleted failing digital audio information. Further, the second set value may be variably set in such a manner that the second set value has a positive correlation with the mean volume value within a predetermined time interval or predetermined number of frames or the volume value derived from the weighting processing in which a data portion farther from the current point is weighted with a smaller coefficient. According to the above manner, it is possible to receive broadcasting data with no problem from an audibility standpoint.

As has been set forth above, even if a frame which has failed to be decoded is deleted and the neighboring frames are brought close to each other in the audibility correction processing, the time adjusting data is inserted to adjust the timing of the frame series with respect to the timing of the broadcast program. Therefore, the reproduced sound can follow the broadcasting program in real time.

As described above, according to the digital audio reproducing apparatus 40 of the second mode, it is possible to carry out excellent, audibility correction on the receiving side practical. Therefore, it is possible to provide continuous broadcasting program reproduction regardless of the occurrence of broadcasting breaks due to radio wave transmission obstacles, without increasing the number of gap fillers or relaying stations. Accordingly, the cost of relaying stations investment can be reduced.

Audibility correcting processing carried out by the audibility correcting means 8 of a third mode will be described hereinafter.

Figures 23A, 23B, 23C, 23D, 23E:
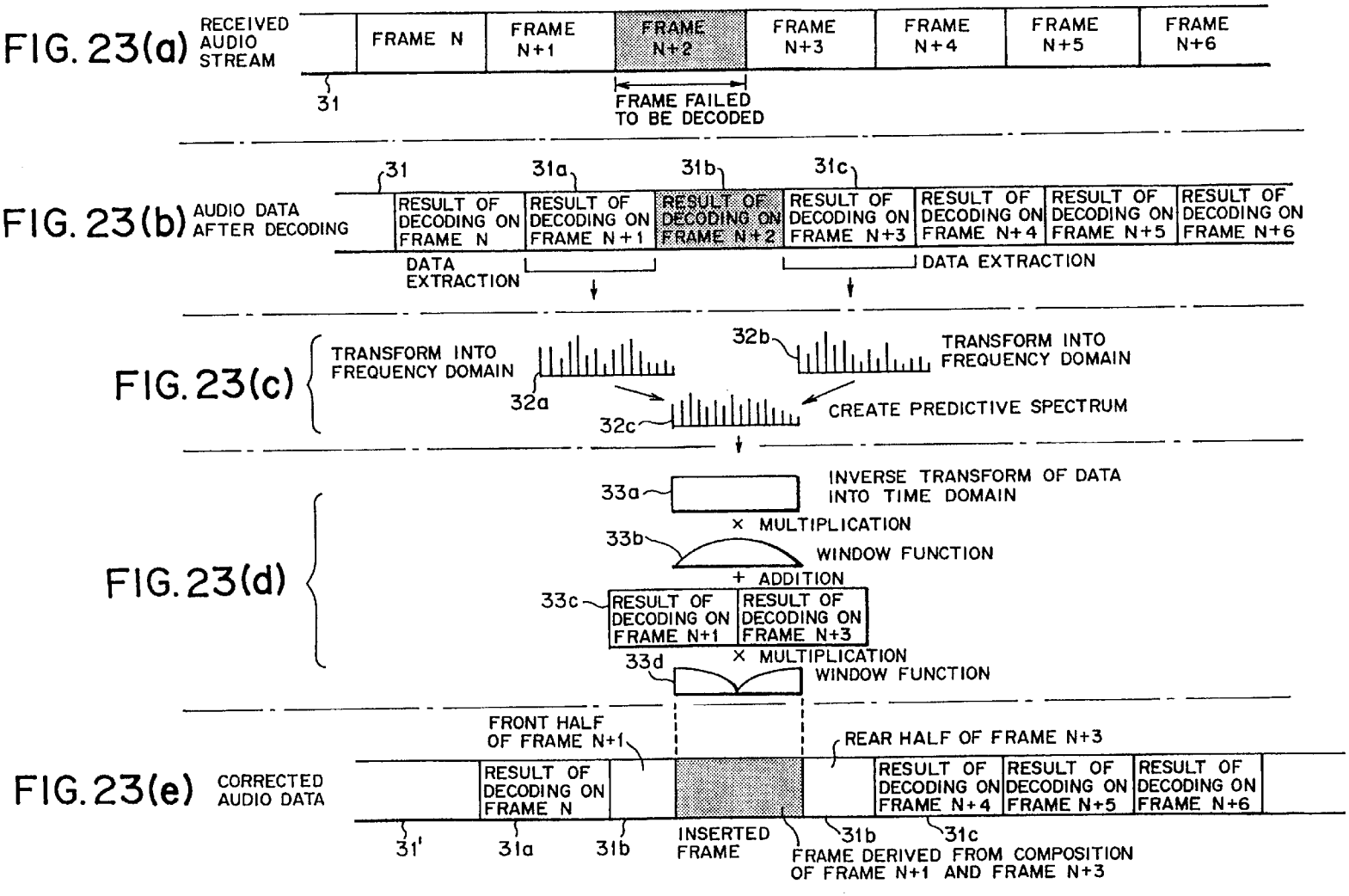
FIG. 23(*a*) is a diagram demonstrating a demultiplexed received audio stream.

FIGS. 23(*a*) to 23(*e*) show the method utilized when a frame which has failed to be decoded is deleted, the neighboring frames are placed close to each other and a frame is created by synthesizing the forward and backward frames via insertion into the frame series.

An audio stream 31 derived from the demultiplexing operation shown in FIG. 23(*a*) is for a series of received data frames containing program data. The series of received data frames lacks data corresponding to a frame number N+2. Thus, data located at a frame position 31*b* shown in FIG. 23(*b*) is deleted and the frame position 31*b* is "stuffed" with a frame which is created by synthesizing the forward and the backward frames of a deleted frame. When the frame insertion is carried out, smoothing processing is also carried out so that sound can be reproduced of a naturally pleasant audibility standpoint. The smoothing processing is achieved at time domain data is transformed once into frequency data, after the frequency domain data is subjected to any processing, then the data is again transformed into time domain data.

That is, a frame of frame number N+1 located at a frame position 31*a* and a frame of frame number N+3 located at a frame position 31*c* shown in FIG. 23(*b*) are extracted from the frame series and the extracted data is transformed into a frequency domain using a technology such as FFT (Fast Fourier Transform), DCT (Discrete Cosine Transform) or (MDCT (Modified Discrete Cosine Transform). Thus, data with frequency spectrums 32*a* and 32*b* as shown in FIG. 23(*c*) are obtained. Then, intermediate frequency domain digital audio information (predictive spectrum 32*c*) is created from the two spectrums 32*a* and 32*b* so that smooth spectrum change is predicted. Functionally, the smoothing process is achieved in this manner with the predictive spectrum 32*c* as intermediate frequency domain digital audio information data is inversely transformed into the time domain data to obtain audio data 33*a* in the time domain as shown in FIG. 23(*d*). Then, the audio data 33*a* is multiplied with a window function 33*b*. On the other hand, audio data 33*c* in which the failing digital audio information is deleted and the frame N+3 is brought close to the frame N+1, is subjected to a smoothing processing on the boundaries between the two frames in such a manner that the second half of the frame N+1 and the first half of the frame N+3 are multiplied with a window function 33*d*. Then, the audio data 33*a* multiplied with the window function 33*b* and the audio data 33*c* multiplied with the window function 33*d* are added together to produce data for interpolation. That is, as shown in FIG. 23(*e*), the interpolating data is inserted at the frame position 31*b* at which the failing digital audio information failed to be decoded was deleted. Thus, corrected data 31' is produced. In this case, since the frame series is shifted by one frame amount that corresponds to the deleted frame amount, the decoded data of frame N+4 is located at the frame position 31*c*.

The smoothing process is carried out in the frequency domain as described above. That is, when the frame N+2 has failed to be decoded, the forward frame N+1 and the backward frame N+3 of the decoding failing frame N+2 are extracted and the data thereof is transformed into the frequency domain. Then, the intermediate frequency domain digital audio data 32*c* is created so that smooth spectrum change between the two frequency spectrums 32*a* and 32*b* is predicted. Thereafter, the intermediate frequency domain digital audio data 32*c* is inversely transformed into the time domain to produce the time series audio data 33*a*. The audibility correcting means 8 multiplies the time series audio data 33*a* with the window function 33*b* and overlays the resulting data with weighting on the vicinity of the boundaries between the data frames which are placed close to each other. Thus, the smoothing processing is achieved. In this case, the overlaying data may be placed on the second half of the frame N+1 and the first half of the frame N+3 to carry out the smoothing more effectively.

According to the above method, a receiver can obtain natural to the sound with no audible noise. Moreover, as described above, according to the digital audio reproducing apparatus of the third mode, it is possible to carry out satisfactory audibility correction from a practical standpoint. Therefore, it is possible to provide continuous broadcasting program reproduction regardless of the occurrence of broadcasting breaks dues to obstacles of radio wave transmission, without increasing the number of gap fillers or relaying stations or their cost investment can be reduced.

Although several embodiments have been described above, these embodiments are merely illustrative and not restrictive. Therefore, it should be noted that those of skill in the art can effect various changes and modifications without departing from the spirit and scope of the invention.

For example, while the above-described embodiments of the audibility correcting means 5, 7, 8 are implemented by the microprocessor 14, the audibility correcting means 5, 7, 8 may be formed of a logic circuit. In this case, the audibility correcting processing will be executed at a faster rate.

Further, while the above audibility correcting processing includes an interpolation processing employing the averaging process with an inclined weight distribution, the interpolation processing is not limited thereto but can be employed with a zero-order interpolation method in which data soon before the current data is utilized for interpolation, a first-order interpolation method in which the forward data and the backward data of the current data are connected to each other by means of a first-order equation, and an N-order interpolation method in which the forward data and the backward data of the current data are connected to each other by means of an N-order equation.

Furthermore, while the above embodiments employ a level coincident method for connecting the discontinuity positions of an audio signal in which the discontinuity positions are connected to each other at a point where the signal waveforms have heights coincident to each other, there are several functions foreseen including a zero-cross method, a cross-fade method, a phase coincident method or the like, and these methods can be easily employed for connecting the discontinuity positions of an audio signal in the scope of the invention disclosed.

The zero-cross method is a function such that the heights of the signal waveforms to be connected to each other are made to have zero level at the connecting point and these signals are connected thereat by the apparats disclosed. The cross-fade method is a function such that signals to be connected to each other are placed in an overlap fashion, and the first half of the overlapped position is faded out while the second half of the same is faded in, whereby the signals are smoothly connected. The phase coincident method is a function such that, in the cross-fade method, the signals to be connected to each other are connected so that phases of the overlapping positions are coincident to each other by the apparatus. All of these functions are employed in the scope and breaker of be present invention.

Further, the audibility correction processing method according to the present invention can be applied not only to an embodiment in which a broadcasting/communication satellite is employed as a transponder, but a case in which broadcasting is carried out by means of ground waves.

Furthermore, the present invention can be applied not only to a broadcast radio wave receiving apparatus but also an apparatus technology field in which a point-to-multipoint communication mode is predominant. For example, the present invention can be applied to a case in which audio information is transmitted together with image information by a paging apparatus by way of a communication satellite. Also, the present invention can be applied to solve transmission problems in a system in which both of a transmitting unit and a receiving unit are arranged as a mobile unit and both of the units suffer from radio wave breaks.

The above-described digital audio reproducing apparatus is not limited to an apparatus for reproducing only digital audio information but the apparatus may be utilized for reproducing both digital audio information and digital video information. That is, the present invention can be applied to an information accumulating apparatus, particularly, a digital reproducing apparatus in which audio information and video information are reproduced by using a device for accumulating digital information. According to the application of the present invention to such apparatus, even if the audio information and the video information are reproduced with a time lag between, the time lag can be satisfactorily corrected from an audibility standpoint.

The audibility correction processing method according to the present invention can be applied not only to a case in which communication is effected by means of radio wave yet also by means of a wired transmission network. For example, when an information distributor reproduces multimedia content in which audio information and video information are integrally arranged, i.e. from an information accumulating medium such as a CD-ROM, a DVD or the like and distributes the contents by way of the internet, information requested is of as an amount of image data compressed based on the MPEG or other information with an audio signal containing sound information, to be reproduced in a synchronous fashion with a time lag achieved within a reasonable level via the present invention. Further, the present invention can be applied to a case in which digital a broadcast program is received by using a digital signal reproducing apparatus carried in a vehicle carry out the audibility correcting processing so that, a driver can enjoy the reproduced sound without any break in programming.

What is claimed is:

1. A digital audio reproducing apparatus, comprising:

receiving means for receiving modulated data containing coded digital audio information, said digital audio information being separated from an audio signal and a picture signal, said modulated data sent in a unit of a frame;

demodulating means for demodulating the modulated data received by the receiving means;

audio decoding means for decoding in a unit of a frame digital audio information contained in the modulated data demodulated by the demodulating means; and audibility correcting means for carrying out audibility correction by using at least one digital audio information out of:

first digital audio information that has been sent before failing digital audio information accommodated in a frame failed to be decoded and has been successfully decoded by the audio decoding means, and second digital audio formation that has been sent after the failing digital audio information and has been successfully decoded by the audio decoding means said one digital audio information being obtained by calculating a predetermined data multiplied with a weighting, when the audio decoding means fails to decode the digital audio information, wherein the audibility correcting means is arranged to carry out the audibility correction by using both of the first digital audio information and the second digital audio information.

2. A digital audio reproducing apparatus according to claim 1, wherein the audibility correcting means further comprises a first smoothing processing means for smoothing the boundary between corrected data that has been subjected to the audibility correction by using the first digital audio information or the second digital audio information and non-corrected data that has not been subjected to the audibility correction.

3. A digital audio reproducing apparatus according to claim 1, wherein the audibility correcting means is arranged to effect an averaging processing with an inclined weight distribution on the first digital audio information and the second digital audio information to create correction data, whereby the audibility correction is carried out.

4. A digital audio reproducing apparatus, comprising:

receiving means for receiving modulated data containing coded digital audio information, said digital audio information being separated from an audio signal and a picture signal, said modulated data sent in a unit of a frame;

demodulating means for demodulating the modulated data received by the receiving means;

audio decoding means for decoding in a unit of a frame digital audio information contained in the modulated data demodulated by the demodulating means;

audibility correcting means for deleting failing digital audio information accommodated in a frame that failed to be decoded, and inserting a normally decoded audio data which is/are placed at a first and/or a second position close to the failing digital audio information, to carry out audibility correction of thus obtained connecting portion, when the audio decoding means fails to decode the digital audio information; and time adjusting data inserting means for inserting time adjusting data useful for correcting a time lag caused when the audibility correcting means deletes the failing digital audio information, wherein the audibility correcting means is arranged such that when the audibility correcting means deletes the failing digital audio information and places pieces of the digital audio information neighboring the failing digital audio information close to each other thereby to carry out the audibility correction, the audibility correcting means selects a position at which the pieces of the digital audio information neighboring the failing digital audio information have the audio signal levels and the audio signal slopes most coincident to each other, said position having a high correlation of a part of the audio signal of a frame before the deleted frame and a part of the audio signal having a high correlation of a frame following the deleted frame.

5. A digital audio reproducing apparatus according to claim 4 wherein the audibility correcting means further comprises second smoothing processing means for smoothing the boundary that is caused when the audibility correcting means deletes the failing digital audio information and places the pieces of the digital audio information neighboring the failing digital audio information close to each other.

6. A digital audio reproducing apparatus, comprising:

receiving means for receiving modulated data containing coded digital audio information, said digital audio information being separated from an audio signal and a picture signal, said modulated data sent in a unit of a frame;

demodulating means for demodulating the modulated data received by the receiving means;

audio decoding means for decoding in a unit of a frame digital audio information contained in the modulated data demodulated by the demodulating means;

audibility correcting means for deleting failing digital audio information accommodated in a frame that failed to be decoded, and inserting a normally decoded audio data which is/are placed at a first and/or a second position close to the failing digital audio information, to carry out audibility correction of thus obtained connecting portion, when the audio decoding means fails to decode the digital audio information; and time adjusting data inserting means for inserting time adjusting data useful for correcting a time lag caused when the audibility correcting means deletes the failing digital audio information, wherein the time adjusting data inserting means is arranged to insert 0-level data, whose level is 0, or minute level data, whose level is minute into the digital audio data at a position with a relatively low audio signal level.

7. A digital audio reproducing apparatus comprising:

receiving means for receiving modulated data containing coded digital audio information, said digital audio information being separated from an audio signal and a picture signal, sent in a unit of frame, demodulating means for demodulating the modulated data received by the receiving means;

audio decoding means for decoding digital audio information contained in the modulated data demodulated by the demodulating means; audibility correcting means for carrying out audibility correction in such a manner that, when the audio decoding means fails to decode the digital audio information, the audibility correcting means deletes failing digital audio information accommodated in a frame failed to be decoded, transforms first digital audio information having a time dimension that has been sent before the failing digital audio information and has been successfully decoded by the audio decoding means and second digital audio information having the time dimension that has been sent after the failing digital audio information and has been successfully decoded by the audio decoding means, into a frequency domain, creates intermediate frequency domain digital audio information from the first digital audio information and the second digital audio information having the frequency dimension after the transform, applies inverse transform on the intermediate frequency domain digital audio information to obtain intermediate digital audio information having the time dimension and weights and places the intermediate digital audio information at the position where the failing digital audio information is deleted or a vicinity thereof, whereby the audibility correction is achieved, and said audibility correcting means is arranged to multiply the intermediate digital audio information with a first window function to obtain first digital audio information and multiply digital audio information, the digital audio information being inserted at the position where the failing digital audio information is deleted or a vicinity thereof, with a second window function, to obtain a second digital audio information and place the first digital audio information and the second digital audio information at the position where the failing digital audio information is deleted or a vicinity thereof.

* * * * *